US011035524B2

(12) United States Patent
Spehalski et al.

(10) Patent No.: US 11,035,524 B2
(45) Date of Patent: Jun. 15, 2021

(54) SELF-SUPPORTING FILAMENT LIGHT EMITTING DIODE LIGHT ENGINE LAMP ASSEMBLY

(71) Applicant: LEDVANCE LLC, Wilmington, MA (US)

(72) Inventors: Tom Spehalski, Emporium, PA (US); Steve Farley, Derry, NH (US)

(73) Assignee: LEDVANCE LLC, Wilmington, MA (US)

( * ) Notice: Subject to any disclaimer, the term of this patent is extended or adjusted under 35 U.S.C. 154(b) by 50 days.

(21) Appl. No.: 16/288,565

(22) Filed: Feb. 28, 2019

(65) Prior Publication Data

US 2019/0338893 A1 Nov. 7, 2019

Related U.S. Application Data

(60) Continuation of application No. 16/207,869, filed on Dec. 3, 2018, now Pat. No. 10,767,818, which is a division of application No. 15/972,326, filed on May 7, 2018, now Pat. No. 10,234,079.

(51) Int. Cl.

| | |
|---|---|
| ***F21K 9/235*** | (2016.01) |
| ***F21K 9/90*** | (2016.01) |
| ***F21K 9/238*** | (2016.01) |
| ***F21K 9/232*** | (2016.01) |
| ***F21Y 103/10*** | (2016.01) |
| ***F21Y 115/10*** | (2016.01) |

(52) U.S. Cl.

CPC ..... *F21K 9/235* (2016.08); *F21K 9/232* (2016.08); *F21K 9/238* (2016.08); *F21K 9/90* (2013.01); *F21Y 2103/10* (2016.08); *F21Y 2115/10* (2016.08)

(58) Field of Classification Search

CPC . F21K 9/90; F21K 9/235; F21K 9/238; F21K 9/232

See application file for complete search history.

(56) References Cited

U.S. PATENT DOCUMENTS

2015/0082955 A1* 3/2015 Zhou ..... H05K 1/0286 83/39

FOREIGN PATENT DOCUMENTS

| | | | | |
|---|---|---|---|---|
| CN | 103791286 A | * | 5/2014 | |
| CN | 203848062 U | * | 9/2014 | |
| CN | 104197281 A | * | 12/2014 | |
| CN | 104482441 A | * | 4/2015 | |
| CN | 204573938 U | * | 8/2015 | ..... F21K 9/232 |
| CN | 204771202 U | * | 11/2015 | |

(Continued)

*Primary Examiner* — Mariceli Santiago
(74) *Attorney, Agent, or Firm* — Tutunjian & Bitetto PC

(57) ABSTRACT

A light emitting diode (LED) light engine that includes an anode supporting base contact having a first arcular geometry; a cathode supporting base contact having a second arcular geometry; and a plurality of light emitting diode (LED) filament structures connected in series, the plurality of light emitting diode (LED) filament structures all connected at a common apex interface, wherein at least a first of the plurality of light emitting diode (LED) filament structures has an anode contact in electrical communication with the anode supporting base contact, and at least a second of the plurality of light emitting diode (LED) filament structures of has a cathode contact in electrical communication with the cathode supporting base contact.

10 Claims, 17 Drawing Sheets

(56) References Cited

FOREIGN PATENT DOCUMENTS

| | | | | | |
|---|---|---|---|---|---|
| CN | 204785675 | U | | 11/2015 | |
| CN | 105202399 | A | | 12/2015 | |
| CN | 304059488 | S | | 2/2017 | |
| CN | 304113170 | S | | 4/2017 | |
| CN | 106895276 | A | | 6/2017 | |
| CN | 304224420 | S | | 7/2017 | |
| CN | 206582575 | U | | 10/2017 | |
| CN | 206582576 | U | | 10/2017 | |
| DE | 102017107004 | A1 | * | 10/2018 | ..... F21K 9/90 |
| KR | 101652240 | B1 | * | 8/2016 | |
| WO | WO-2018194386 | A1 | * | 10/2018 | ..... H01L 23/00 |

* cited by examiner

SELF-SUPPORTING FILAMENT LIGHT EMITTING DIODE LIGHT ENGINE LAMP ASSEMBLY

TECHNICAL FIELD

The present disclosure generally relates to light engines employed in lamp assemblies, and more particularly to light engines employing light emitting diodes for the light source.

BACKGROUND

Recently, lighting devices have been developed that make use of light emitting diodes (LEDs) for a variety of lighting applications. Owing to their long lifetime and high energy efficiency, LED lamps are now also designed for replacing traditional incandescent and fluorescent lamps, i.e., for retrofit applications. For such applications, the LED retrofit lamp is typically adapted to fit into the socket of the respective lamp fixture to be retrofitted. Additionally, the light engine for the retrofit LED lamps should be of a design for automated construction should fit within the conventionally used bulb assembly dimensions.

SUMMARY

In one aspect, a light engine is provided that employs filament light emitting diodes (LEDs) that is suitable for use in lamps, such as retrofit light emitting diode (LED) lamps. The light engine design of the present disclosure is suitable for automated construction. The filament light emitting diodes (LEDs) make use of the frame structure of the filament light emitting diodes (LEDs) to construct the light engine without auxiliary arbor and wire support structure.

In one embodiment, the light emitting diode (LED) light engine includes an anode supporting base contact having a first arcular geometry, a cathode supporting base contact having a second arcular geometry, and a plurality of light emitting diode (LED) filament structures. The plurality of light emitting diode (LED) filament structures are all connected at a common apex interface. At least a first of the plurality of light emitting diode (LED) filament structures has an anode contact in electrical communication with the anode supporting base contact, and at least a second of the plurality of light emitting diode (LED) filament structures of has a cathode contact in electrical communication with the cathode supporting base contact. The anode and cathode contacts for each of the plurality of light emitting diode (LED) filament structures are provided by the frame structure that is employed in the manufacture of a plurality of light emitting diode (LED) filaments.

In another aspect, a lamp structure is provided that includes a light engine that employs filament light emitting diodes (LEDs). In one embodiment, a lamp is provided that includes a housing including a light projecting end and a base having an electrical connector for connection with a lamp fixture; and a light engine positioned within the housing to project light through the light projecting end. The light engine includes an anode supporting base contact having a first arcular geometry, a cathode supporting base contact having a second arcular geometry, and a plurality of light emitting diode (LED) filament structures. The plurality of light emitting diode (LED) filament structures are connected at a common apex interface. At least a first of the plurality of light emitting diode (LED) filament structures has an anode contact in electrical communication with the anode supporting base contact, and at least a second of the plurality of light emitting diode (LED) filament structures of has a cathode contact in electrical communication with the cathode supporting base contact. The anode and cathode contacts for each of the plurality of light emitting diode (LED) filament structures are provided by the frame structure that is employed in the manufacture of a plurality of light emitting diode (LED) filaments.

In yet another aspect of the present disclosure, a method of forming light engines is provided that provides a cone style assembly of light emitting diode (LED) filaments. In one embodiment, the method of forming a light source is provided that includes positioning a supporting ring for the light source on a ring positioning base surface of the mandrel welding electrode; and positioning at least two light emitting diode filament structures that are joined at a weldment at a first electrode end of the at least two light emitting diode filament structures on a centering surface at first end of the mandrel welding electrode. The ring positioning base surface is present at an opposing second end of the mandrel welding electrode. The method may continue with joining each of the second electrode end for the filament light emitting diodes of the at least two light emitting diode (LED) filament structures to the supporting ring of the light source. The supporting ring may be sectioned to provide portions that are separately in contact with anode contacts and cathode contacts of the at least two light emitting diode (LED) filament structures.

In one embodiment, the at least two light emitting diode filament structures are joined by the weldment at a welding station that is separate from the mandrel welding electrode. In one embodiment, following said welding station at which the at least two light emitting diode filament structures are joined by weldment, the at least two light emitting diode filament structures that are joined at the weldment are deformed on a deformation mandrel to have a filament assembly geometry that substantially aligns to a sidewall geometry of the mandrel welding electrode. In this embodiment, the deformation mandrel is separate from the mandrel welding electrode.

In another embodiment, the at least two light emitting diodes are joined by at a first end electrode end at said welding station, and following said welding station, the method further includes deforming the at least two light emitting diode (LED) filament structures while present on the mandrel welding electrode to provide that the second electrode end contacts the supporting ring for the light source.

In yet another embodiment, the method of forming a light engine includes positioning a mandrel welding electrode in a base structure having a plurality of perimeter supporting pedestals. The mandrel welding electrode includes a centering surface at a first end of the mandrel welding electrode and a ring positioning base surface at a second end of the mandrel welding electrode. The method further includes positioning a supporting ring for the light engine on the ring positioning base surface of the first welding electrode, and positioning at least two light emitting diode (LED) filament structures on the mandrel welding electrode and the base structure. In some embodiments, for filament light emitting diodes of at least two light emitting diode (LED) filament structures a first electrode end is positioned on the centering surface of the mandrel welding electrode and a second electrode end is positioned on one of said plurality of perimeter supporting pedestals of the base structure. The method continues with joining together each of the first electrode end for the filament light emitting diodes of the at least two light emitting diode (LED) filament structures at the centering surface of the mandrel welding electrode. In a following step, support to the second electrode end for the filament light emitting diodes of the at light emitting diode (LED) filament structures that was provided by the plurality of perimeter supporting pedestals is removed. The at least two light emitting diode (LED) filament structures is deformed to provide that the second electrode end contacts the supporting ring for the light source at the second end of the mandrel welding electrode. The second electrode end for each of the filament light emitting diodes of the at least two light emitting diode (LED) filament structures is joined to the supporting ring of the light source.

BRIEF DESCRIPTION OF THE DRAWINGS

The following description will provide details of embodiments with reference to the following figures wherein.

DETAILED DESCRIPTION

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

The present disclosure describes a light engine that employs filament light emitting diodes (LEDs) that is suitable for use in lamps, such as retrofit light emitting diode (LED) lamps. The light engine includes a plurality of light emitting diode (LED) filament structures connected in series so that the plurality of light emitting diode (LED) filament structures are all connected at a common apex interface. The opposing ends of the plurality of light emitting diode (LED) filament structures are connected to either an anode supporting base contact or cathode supporting base contact. The plurality of light emitting diode (LED) filament structures, the anode supporting base contact, and the cathode supporting base contact are the only structures of the light engine that extend above the stem for the lamp. In this manner, the light engine is self-supporting. The methods and structures of the present disclosure make use of the frame structure of the filament light emitting diodes (LEDs) to construct the light engine without auxiliary arbor and wire support structure. The light engine design of the present disclosure is suitable for automated construction. In some embodiments, the methods and structures described herein employ a ring bottom connection for the light engine that can be welded to a stem structure. The methods and structures of the present disclosure are now described in greater detail with reference to FIGS. 1A to 11C.

Figure 1B:
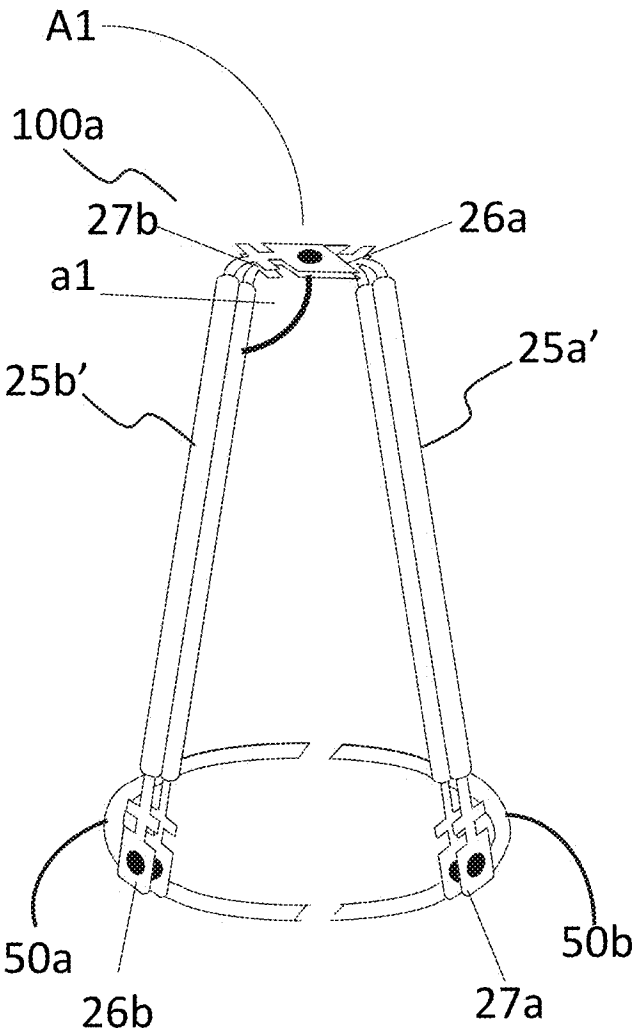
FIG. 1B is a perspective view of another embodiment of a light engine in which each of the plurality of light emitting diode (LED) filament structures included two light emitting diode filaments electrically connected in parallel.
Figure 1A:
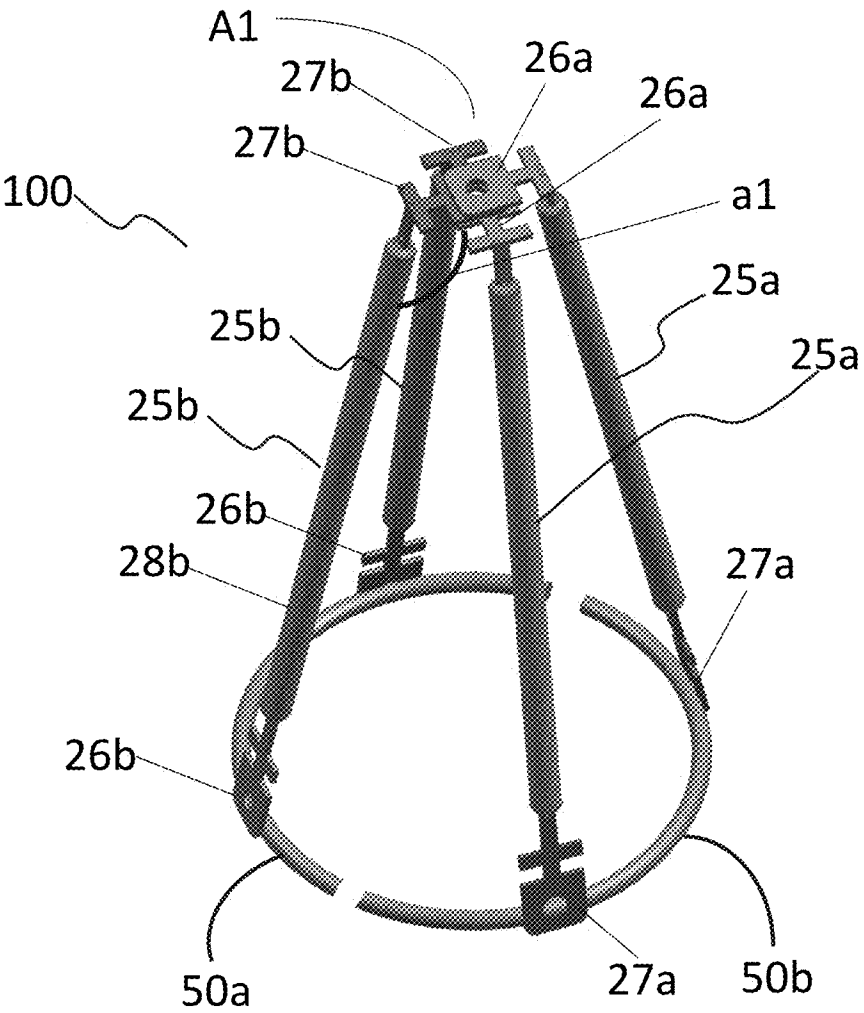
FIG. 1A is a perspective view of a light engine having a cone like geometry including an anode supporting base contact having a first arcular geometry, a cathode supporting base contact having a second arcular geometry, and a plurality of light emitting diode (LED) filament structures, in accordance with one embodiment of the present disclosure.

FIG. 1A depicts one embodiment of a light engine 100 having a cone like geometry including an anode supporting base contact 50*a* having a first arcular geometry, a cathode supporting base contact 50*b* having a second arcular geometry, and a plurality of light emitting diode (LED) filament structures 25*a*, 25*b*. In the embodiment that is depicted in FIG. 1A, the plurality of light emitting diode (LED) filament structures 25*a*, 25*b* includes four light emitting diode filament structures 25*a*, 25*b* that are arranged in a cone like geometry. A "cone-like" geometry is a three-dimensional geometric shape that tapers from a substantially flat base to a point called the apex of the cone. In some embodiments, the plurality of light emitting diode (LED) filament structures 25*a*, 25*b* all connected at a common apex interface A1, in which the common apex interface A1 of the connected plurality of light emitting diodes (LED) filament structures provides the apex of the cone like geometry.

Figure 2B:
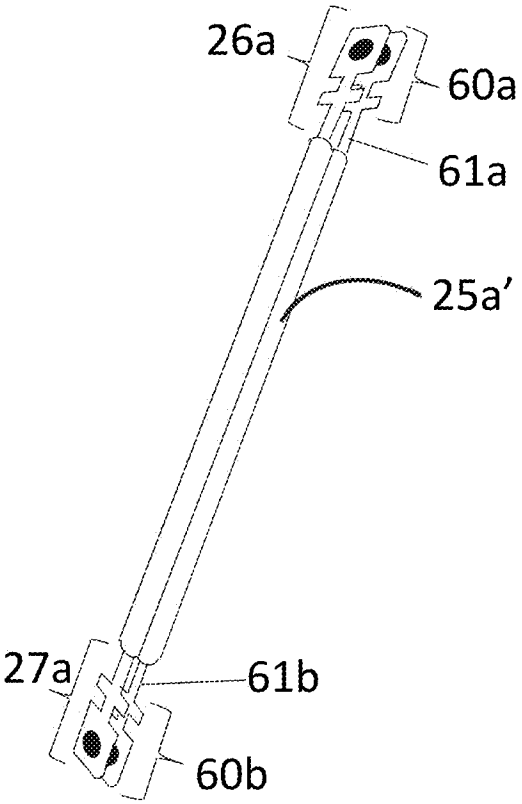
FIG. 2B is a perspective view of a light emitting diode (LED) filament structure composed of two light emitting diode (LED) filaments that are electrically connected in parallel, in accordance with one embodiment of the present disclosure.
Figure 2A:
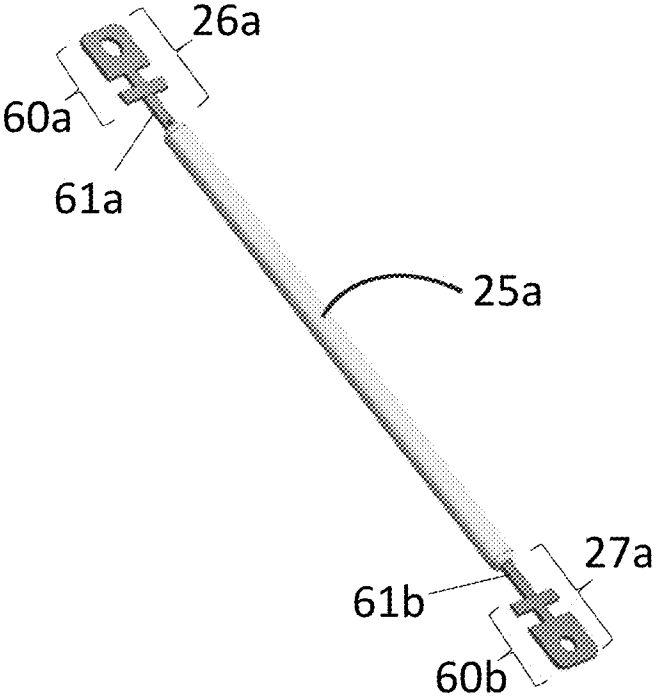
FIG. 2A is a perspective view of a light emitting diode (LED) filament, in accordance with one embodiment of the present disclosure.

Each of the plurality of light emitting diode (LED) filament structures 25*a*, 25*b* in the light engine 100 depicted in FIG. 1A includes a cathode contact portion 27*a*, 27*b*, an anode portion 26*a*, 26*b*, and a substrate 28*a*, 28*b* positioned between the anode contact portion 26*a*, 26*b* and the cathode contact 27*a*, 27*b*. FIG. 2A depicts one embodiment of a light emitting diode (LED) filament 25*a*, 25*b* prior to the light emitting diode (LED) filament structures 25*a*, 25*b* being integrated into the light engine 100 depicted in FIG. 1A.

Referring to FIGS. 1A and 2A, the substrate 28*a*, 28*b* for each of the light emitting diode (LED) filament structures 25*a*, 25*b* includes a plurality of series connected light emitting diodes (LEDs) present on the substrate 28*a*, 28*b* and extending from the cathode contact portion 27*a*, 27*b* to the anode contact portion 26*a*, 26*b*. A light emitting diode is a form of solid state light emitter. The term "solid state" refers to light emitted by solid-state electroluminescence, as opposed to incandescent bulbs (which use thermal radiation) or fluorescent tubes, which use a low pressure Hg discharge. In a broad sense, a light emitting diode (LED) is a semiconductor device that emits visible light when an electric current passes through it. Some examples of solid state light emitters that are suitable for the methods and structures described herein include inorganic semiconductor light-emitting diodes (LEDs), organic light-emitting diodes (OLED), polymer light-emitting diodes (PLED), surface mount light emitting diodes (SMT LEDs) or combinations thereof. The series connected light emitting diodes (LEDs) that are present on the substrate 28*a*, 28*b* are not depicted in the supplied figures, because they are covered with a phosphorus coating.

Referring to FIGS. 1A and 2A, each of the light emitting diode (LED) filament structures 25*a*, 25*b* includes LED's arranged in rows on small strips. In one example, the number of LEDs arranged on the substrate 28*a*, 28*b* of the light emitting diode (LED) filaments structures can range from 10 LEDs to 50 LEDs. In another example, the number of LEDs arranged on the substrate 28*a*, 28*b* may range from 15 LEDs to 40 LEDs. In yet another example, the number of LEDs arranged on the substrate 28*a*, 28*b* may range from 20 LEDs to 30 LEDs. The LEDs present on the substrate 28*a*, 28*b* can be electrically connected in series extending from the cathode contact portion 27*a*, 27*b* to the anode contact portion 26*a*, 26*b*.

In some embodiments, the LED filament 25*a*, 25*b* is composed of a metal strip with series of LEDs aligned along it. A transparent substrate, usually made from glass, e.g., silicon (Si) and/or silicon oxide ($SiO_2$), or sapphire, e.g., aluminum oxide ($Al_2O_3$), materials are used to cover the LED's. This transparency allows the emitted light to disperse evenly and uniformly without any interference or light loss. The LEDs may be referred to as chip on board (COB) and/or chip on glass (COG).

In one example, the LED's on the filament strip emit a blue colored light. For example, the blue light emitted by the LEDs on the filament strip of the LED filaments 25*a*, 25*b* may have wavelengths ranging from approximately 490 nm to 450 nm. To provide "white light" a coating of phosphor in a silicone resin binder material is placed over the LEDs and glass to convert the blue light generated by the LEDs. White light is not a color, but a combination of all colors, hence white light contains all wavelengths from about 390 nm to 700 nm. Different phosphor colors can be used to change the color of the light being emitted by the LEDs. For example, the more yellow the phosphor, the more yellow and warm the light becomes.

In some embodiments, the white light emitted by the light emitting diode (LED) filament structures 25*a*, 25*b* have a color temperature ranging from 2700K to 6500K. In one example, the white light emitted by the LED filaments structures 25*a*, 25*b* may be referred to a "day white" with a temperature ranging from 3800K to 4200K. In another example, the white light emitted by the light emitting diode (LED) filament structures 25*a*, 25*b* may have a warm white light with a temperature ranging from around 2600K to 3000K. It is noted that the above examples are provided for illustrative purposes only, and are not intended to limit the present disclosure.

Each of the light emitting diode (LED) filament structures 25*a*, 25*b* may have a length on the order of 4" and a width on the order of ⅛".

Still referring to FIGS. 1A and 2A, the light emitting diode (LED) filament structures 25*a*, 25*b* each include a cathode contact portion 27*a*, 27*b*, and an anode contact portion 26*a*, 26*b*. The anode and cathode are defined by the flow of current. In the general sense, current refers to any movement of electrical charge. The cathode contact portion 27*a*, 27*b* is the negatively charged electrode for the light emitting diode (LED) filament structures 25*a*, 25*b*. The anode contact portion 26*a*, 26*b* is the positively charged electrode for the light emitting diode (LED) filament structures 25*a*, 25*b*. The anode and cathode contact portions 26*a*, 26*b*, 27*a*, 27*b* for each of the light emitting diode (LED) filament structures 25*a*, 25*b* are either joined, e.g., by weldment, to the anode supporting base contact 50*a* having the first arcular geometry, the cathode supporting base contact 50*b* having the second arcular geometry, or are joined at the common apex interface A1 to provide that the plurality of light emitting diode (LED) filament structures are all connected. For example, a first set of LED filament structures (each identified by reference number 25*a*) of the plurality of light emitting diode (LED) filament structures 25*a*, 25*b* has an anode contact portion 26*a* that are joined together at the common apex interface A1 that provides the apex of the cone like geometry of the light engine 100; and a second set of LED filament structures (each identified by reference number 25*b*) of the plurality of light emitting diode (LED) filament structures 25*a*, 25*b* has a cathode contact portion 27*b* that are joined together at the common apex interface A1. The anode contact portions 26*a* of the first set of LED filament structures (each identified by reference number 25*a*) at the common apex interface A1 are connected to the cathode contact portions 27*b* of the second set of LED filament structures (each identified by reference number 25*b*) at the common apex interface A1. This provides that all of the LED filament structures, i.e., the first set of LED filament structures 25*a* and second set of LED filament structures 25*b*, are all interconnected at the common apex interface A1.

Still referring to FIGS. 1A and 2A, the opposite ends of the LED filament structures 25*a*, 25*b* from the common apex interface A1 are connected to either the anode supporting base contact 50*a* or the cathode supporting base contact 50*b*. For example, the first set of LED filament structures (each identified by reference number 25*a*) of the plurality of light emitting diode (LED) filament structures 25*a*, 25*b* have cathode contact portion 27*a* that are separately joined at the cathode supporting base contact 50*b*; and the second set of LED filament structures (each identified by reference number 25*b*) of the plurality of light emitting diode (LED) filament structures 25*a*, 25*b* have an anode contact portion 26*b* that are separately joined at the anode supporting base contact 50*a*.

Figure 4:
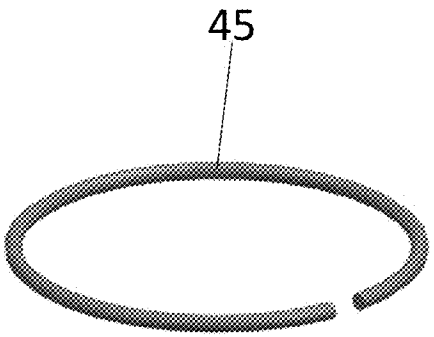
FIG. 4 is a perspective view of a snap-in C-ring for providing the anode supporting base contact having a first arcular geometry and the cathode supporting base contact having a second arcular geometry for the light engine depicted with reference to FIGS. 1A and 1B.

In some embodiments, the anode supporting base contact 50*a*, and the cathode supporting base contact 50*b*, each have an arcular geometry. The term "arcular" denotes that the geometry consists of at least one "arc". The term "arc" denotes a part of the circumference of a circle or other curve. The anode support base contact 50*a*, and the cathode supporting base contact 50*b*, may each be provided by a sectioned portion of a snap ring 45. FIG. 4 is a perspective view of a snap-in C-ring for providing the anode supporting base contact 50*a* having a first arcular geometry and the cathode supporting base contact 50*b* having a second arcular geometry for the light engine depicted with reference to FIG. 1A.

Figure 1D:
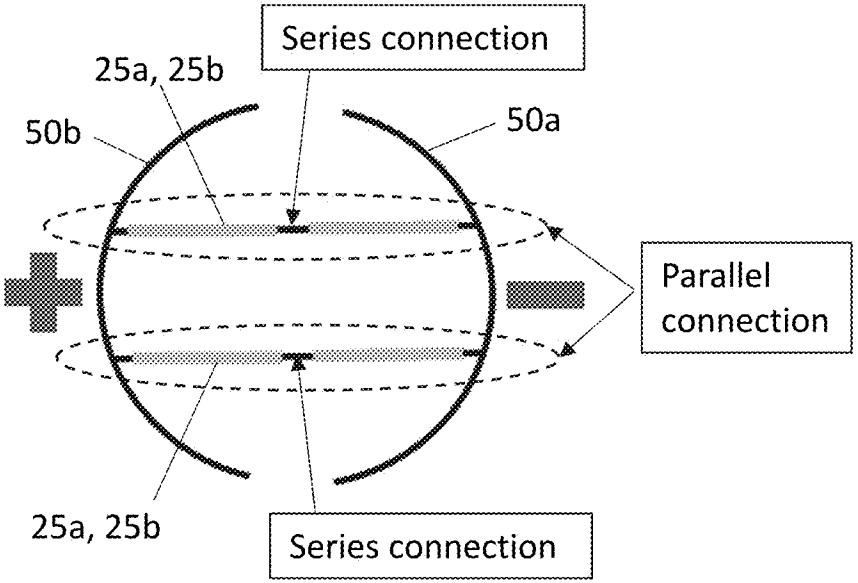
FIG. 1D is a top down view of another embodiment of a self-supporting light engine illustrating the parallel and series electrical connectivity of the light emitting diode (LED) filaments of the self-supporting light engine.
Figure 1C:
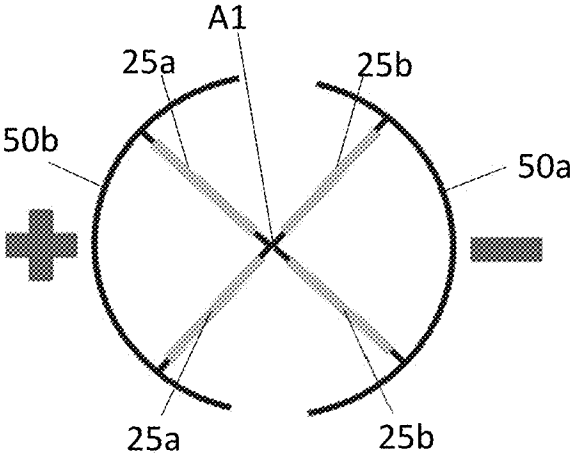
FIG. 1C is a top down view of the structure depicted in FIG. 1A illustrating the positive and negative connections to the self-supporting light engine.

The interconnectivity of the plurality of light emitting diode (LED) filament structures 25*a*, 25*b* at the common apex A1 and the connectivity of the plurality of light emitting diode (LED) filament structures 25*a*, 25*b*, the anode supporting base contact 50*a*, and the cathode supporting base contact 50*b* is further illustrated in FIGS. 1C and 1D. FIG. 1C is a top down view of the structure depicted in FIG. 1A illustrating the positive and negative connections to the self-supporting light engine. The positive connections are illustrated by the positive sign and the negative connections are illustrated by the negative sign. The cathode supporting base contact 50*b* corresponds to the positive connections, and the anode supporting base contact 50*a* corresponds to the negative connections. FIG. 1C illustrates one embodiment in which there are two filament pairs in parallel electrical connection, with each pair of the two filament pairs in series electrical connection. Each of the filament structures 25*a*, 25*b* are connected. The light engine is self-supporting.

FIG. 1D is a top down view of another embodiment of a self-supporting light engine illustrating the parallel and series electrical connectivity of the light emitting diode (LED) filaments of the self-supporting light engine. As illustrated in FIG. 1D, each pair of light emitting diode (LED) filament structures 25*a*, 25*b* are connected in series. Referring to FIG. 1D and number of pairs may be aided in parallel to achieve the desired light output. For example, a light engine having only two light emitting diode (LED) filament structures 25*a*, 25*b* would include the two filaments connected in series, as a single pair. In another example, a light engine having four light emitting diode filament structures 25*a*, 25*b*, as depicted in FIG. 1D, would include two pairs of filament structures 25*a*, 25*b* connected in series. The two pair of filament structure 25*a*, 25*b* are connected in parallel. This relationship is illustrated in FIG. 1D. In another example, the light engine may include six light emitting diode filament structures 25*a*, 25*b*. In this example, there may be three pair of two light emitting diode filament structures 25*a*, 25*b* connected in series, i.e., the two light emitted filament structures in the pair are connected in series. The three pair of two light emitting diode filament structures 25*a*, 25*b* are then connected in parallel.

The method for forming the light engine 100 is further described below. In some embodiments, the snap ring 45 is joined to the cathode contact portion 27*a* of the first set of LED filament structures 25*a*, and the snap ring 45 is joined to the anode contact portion 26*b* of the second set of LED filament structures 25*b*. In these embodiments, the snap ring is substantially circular in geometry, and following joining of the anode and cathode contact portions 26*b*, 27*a* of the LED filament structures 25*a*, 25*b*, the snap ring is sectioned to provide the cathode supporting base portion 50*a* that is separate from the anode supporting base portion 50*b*. In this embodiment, because the snap ring was substantially circular in geometry, each of the anode and cathode contact portions 50*a*, 50*b* may have the geometry of a semicircle arc. In some embodiments, each of the first arcular geometry of the anode supporting base contact 50*a* and the second arcular geometry of the cathode supporting base contact 50*b* includes a C type geometry, wherein each of said C-type geometry is arranged to provide a substantially circular base for the light engine 100. In some embodiments, a width of the substantially circular base 50*a*, 50*b* for the light engine 100 is greater than a width of the common apex interface A1. It is noted that these are only some examples for the geometry for the base of the light engine 100. In other embodiments, the anode and cathode contact supporting base portions 50*a*, 50*b* may have the geometry of an oblong like arc, or the anode, and cathode contact supporting base portions 50*a*, 50*b* may be multisided, e.g., rectangular and/or square.

Figure 3:
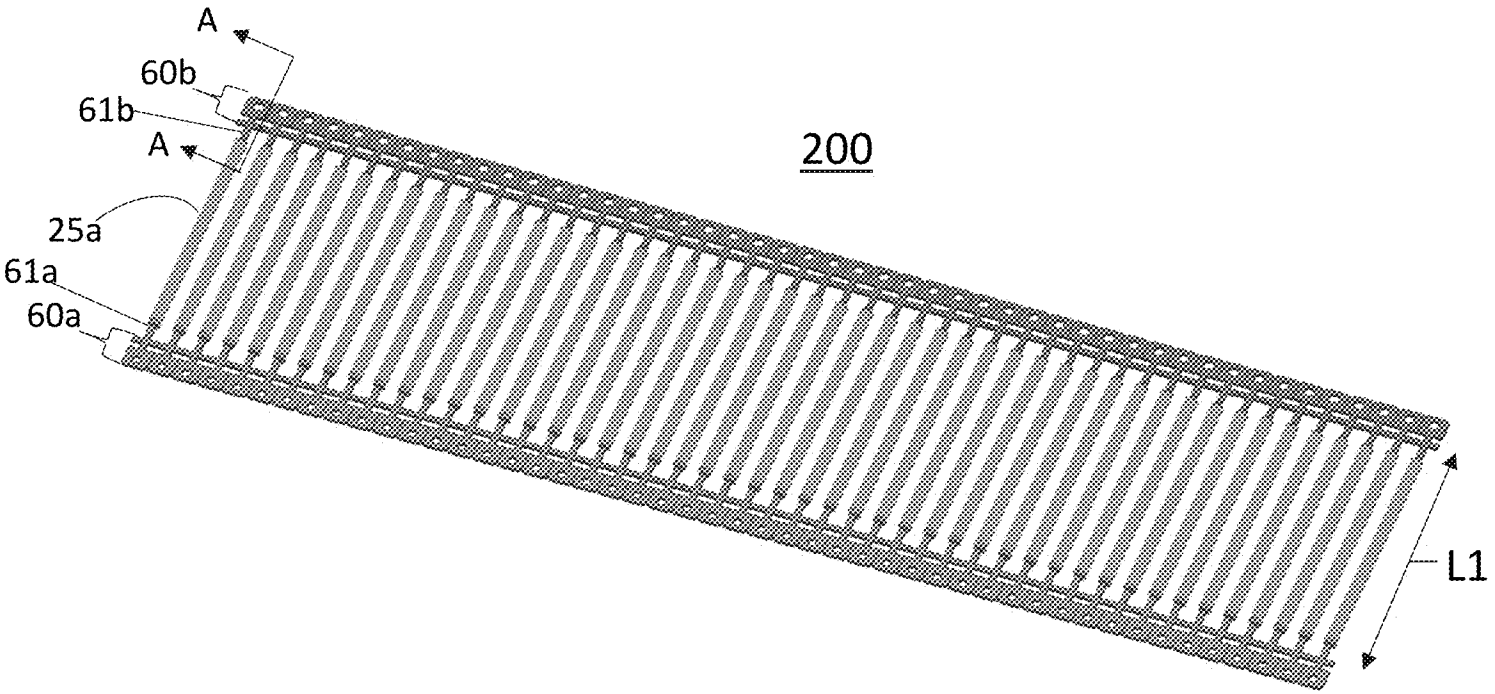
FIG. 3 is a perspective view depicting one embodiment of an assembly of a plurality of light emitting diode (LED) filament structures, in which adjacent filaments are joined by a frame structure, and the length of adjacent filaments are parallel to one another, in accordance with one embodiment of the present disclosure.

Referring to FIGS. 1A, 2A, and 3, the anode and cathode contact portions 26*a*, 26*b*, 27*a*, 27*b* of the light emitting diode (LED) filament structures 25*a*, 25*b* make use of the frame structure of the filament light emitting diodes (LEDs) to construct the light engine 100 without auxiliary arbor and wire support structure.

FIG. 3 depicts one embodiment of an assembly 200 of a plurality of light emitting diode (LED) filament structures 25*a*, 25*b* (only labelled 25*a* in FIG. 3), in which adjacent filaments 25*a* are joined by a frame structure 60*a*, 60*b*, and the length LI of adjacent filaments 25*a* are parallel to one another. The frame structure 60*a*, 60*b* is the portion of the assembly 200 that is joining the plurality of light emitting diode (LED) filament structures 25. The assembly 200 of the plurality of light emitting diodes (LED) filament structures 25*a* is the configuration that is provided by manufacturing of the plurality of light emitting diodes (LED) filament structures 25*a*. To provide singular light emitting diode (LED) filament structures 25*a* from the assembly, the assembly 200 is sectioned at the interface of the frame structures 60*a*, 60*b* that provide the anode and cathode contact portions 26*a*, 27*a* for adjacent LED film structures 25*a* in the assembly 200. The section line identified by A-A is one example of an interface between the portions of the frame assembly 60*a*, 60*b* that provide the anode and cathode contacts 26*a*, 27*a* for each of the plurality of light emitting diode (LED) filament structures 25*a* in the assembly 200 provided in the manufacture of a plurality of light emitting diode (LED) filaments 25*a*. The sectioning may be provided by a cutting operation.

In prior methods, the components of the frame assembly 200 are also sectioned from the plurality of light emitting diodes (LED) filament structures 25*a* prior to the use of the light emitting diodes (LED) filament structures 25*a* in light engines. Referring to FIGS. 2A and 3, each of the anode and cathode contact portions 26*a*, 27*a* for adjacent LED film structures 25*a* in the assembly 200 includes a portion provided by the frame structure 60*a*, 60*b*. The frame structure 60*a*, 60*b* is connected to the substrate portion including the LEDs of the light emitting diode (LED) filament structures 25*a* by an anode connecting portion 61*a* and a cathode connecting portion 61*b*. In prior methods, the frame portions 60*a*, 60*b* are removed, and the light emitting diode (LED) filament structures 25*a* are electrically connected by electrical contact to the remaining anode connecting portion 61*a* and a cathode connecting portion 61*b*. In the methods and structures of the present disclosure, the frame portions 60*a*, 60*b* of the anode and cathode contact portions 26*a*, 27*a* for the LED filament structures 25*a*, 25*b* provide for interconnectivity of the LED filament structures 25*a*, 25*b* at the common apex interface A1. In the methods and structures of the present disclosure, the frame portions 60*a*, 60*b* of the anode and cathode contact portions 26*a*, 27*a* at the opposing end of the LED filament structures 25*a*, 25*b* from the common apex interface A are in electrical communication with the anode and cathode contact supporting base portions 50*a*, 50*b*.

The frame portions 60*a*, 60*b* at the common apex interface A1 provide a planar upper surface for the light engine 100 that is depicted in FIG. 1A. The base of the light engine 100 provided by the anode and cathode contact supporting base portions 50*a*, 50*b* has a width greater than the planar upper surface of the light engine 100. To provide the increasing width in the direction from the planar upper surface of the light engine to the base of the light engine, the transition between the frame portions 60*a*, 60*b* at the common apex interface A1 and the anode and cathode connecting portions 61*a*, 61*b* at the upper surface of the light engine 100 includes an angle $\alpha$1 ranging from 40° to 90°. In another embodiment, the angle $\alpha$1 at the transition between the frame portions 60*a*, 60*b* at the common apex interface A1 and the anode and cathode connecting portions 61*a*, 61*b* at the upper surface of the light engine 100 may range from 45° to 75°. The aforementioned examples for the angle $\alpha$1 at the transition between the frame portions 60*a*, 60*b* at the common apex interface A1 and the anode and cathode connecting portions 61*a*, 61*b* at the upper surface of the light engine 100 are provided for illustrative purposes only, and are not intended to limit the present disclosure. In other examples, the angle $\alpha$1 at the transition between the frame portions 60*a*, 60*b* at the common apex interface A1 and the anode and cathode connecting portions 61*a*, 61*b* at the upper surface of the light engine 100 may be equal to 45°, 55°, 60°, 65°, 70°, 75°, 80° and 85°, as well as any range of values for the angle $\alpha$1 including one of the aforementioned examples for the minimum endpoint for the range, and one of the aforementioned examples for the maximum endpoint for the range. In some embodiments, the transition between the frame portions 60*a*, 60*b* at the anode and cathode contact supporting base portions 50*a*, 50*b* and the anode and cathode connecting portions 61*a*, 61*b* of the LED filament structures 25*a*, 25*b* at the base surface of the light engine 100 does not include a bend, i.e., bending angle.

It is noted that the light engine 100 of the present disclosure is not limited to including four light emitting diode (LED) filament structures 25*a*, 25*b* that are electrically interconnected at an upper surface of the light engine 100 at the common apex interface A1 and each separately connected to one of the anode and cathode contact supporting base portions 50*a*, 50*b*, as depicted in FIG. 1A. The light engines 100 of the present disclosure may include other numbers light emitting diode (LED) filament structures 25*a*, 25*b*. For example, the number of light emitting diode (LED) filament structures 25*a*, 25*b* positioned between the common apex interface A1 and the anode and cathode contact supporting base portions 50*a*, 50*b* may be equal to 2, 3, 4, 5, 6, 7, 8, 9, 10 and 15, as well as any range of light emitting diode (LED) filament structures 25*a*, 25*b* including one of the aforementioned examples for the minimum endpoint for the range, and one of the aforementioned examples for the maximum endpoint for the range.

The methods and structures of the present disclosure are not limited to on the geometry for the light engine 100 that is depicted in FIG. 1A. FIG. 1B depicts another embodiment of a light engine 100*a* in which each of the plurality of light emitting diode (LED) filament structures 25*a*', 25*b*' included two light emitting diode filaments electrically connected in parallel. By connected in parallel it is meant that two LED filaments are electrically connected so that the anode contact of the first LED filament is connected to the anode contact of the second LED filament; and that the cathode contact of the first LED filament is connected to the cathode contact of the second LED filament for each of the two of light emitting diode (LED) filament structures 25*a*', 25*b*' depicted in FIG.

1B. FIG. 2B depicts one embodiment of a light emitting diode (LED) filament structure 25*a*' (25*b*' is similar) composed of two light emitting diode (LED) filaments that are electrically connected in parallel. The light emitting diode (LED) filaments depicted in FIG. 2B is similar to the light emitting diode filament structure 25*a* prime that is depicted in FIG. 2A. Therefore, the description of the single light emitting diode (LED) filament structure 25*a* that is depicted in FIG. 2A is suitable for each of the LED filaments that are connected in parallel in the LED filament structure 25*a*' that is depicted in FIG. 2B. For example, each of the LED filaments that are connected in parallel in the LED filament structure 25*a*' include a substrate supporting a plurality of series connected LEDs covered in a phosphor coating, an anode contact portion 26*a*, and a cathode contact portion 27*a*. Similar to the LED filament structure 25*a* that is depicted in FIG. 2A, each of the LED filaments that are connected in parallel of the LED filament structure 25*a*' depicted in FIG. 2B have anode and cathode contact portions 26*a*, 27*a* that include frame portions 60*a*, 60*b* and anode and cathode connecting portions 61*a*, 61*b*.

The light emitting diode (LED) filament structure 25*a*' that is depicted in FIG. 2B provides one example of a light emitting diode (LED) filament structure 25*a*' (as well as 25*b*') for use in the light engine 100' that is depicted in FIG. 1B. An upper surface of the light engine 100*a* includes a common apex interface A1 at which a first end of the light emitting diode (LED) filament structures 25*a*', 25*b*' including the parallel connected LED filaments are interconnected, and a base surface at which the light emitting diode (LED) filament structures 25*a*', 25*b*' separately contact one of the anode and cathode contact supporting base portions 50*a*, 50*b*. The light engine 100*a* that is depicted in FIG. 1B is similar to the light engine 100 that is depicted in FIG. 1A, with the exception that the light emitting diode (LED) filament structures 25*a*, 25*b* of the light engine 100 depicted in FIG. 1A each include a single light emitting diode (LED) filament, while the light emitting diode (LED) filament structures 25*a*', 25*b*' that are depicted in FIG. 1B each include two light emitting diode (LED) filament structures that are connected in parallel. Therefore, the description of the light engine 100 depicted in FIG. 1A is suitable for describing portions of the light engine 100A depicted in FIG. 1B. For example, the description of the anode and cathode contact supporting base portions 50*a*, 50*b* depicted in FIG. 1A is suitable for describing the anode and cathode contact supporting base portions 50*a*, 50*b* that are depicted in FIG. 1B. Similar to the light engine 100 depicted in FIG. 1A, for the light engine 100A depicted in FIG. 1B, the common apex interface A1 provides at point where the light emitting diode (LED) filament structures 25*a*', 25*b*' are interconnected at a planar upper surface of the light engine 100*a*, in which contact between the light emitting diode (LED) filament structures 25*a*', 25*b*' at the common apex interface A1 is provided by joining the frame portions 60*a*, 60*b* of the anode and cathode contact portions 26*a*, 27*a* of the light emitting diode (LED) filament structures 25*a*', 25*b*'. Referring to FIG. 1B, different from the embodiment that is depicted in FIG. 1A, there are two frame portions 60*a*, 60*b* for each of the light emitting diode (LED) filament structures 25*a*', 25*b*' due to the parallel connection of the two LED filaments for each of the light emitting diode (LED) filament structures 25*a*', 25*b*'. This provides that there are two frame portions 60*a*, 60*b* for each light emitting diode (LED) filament structures 25*a*', 25*b*' at the contacts to the common apex interface A1 and the anode and cathode contact supporting base portions 50*a*, 50*b*. Similar to the light engine 100 that is depicted in FIG. 1A, the light emitting diode (LED) filament structures 25*a*', 25*b*' have a bend angle α1 at the transition of the frame portions 60*a*, 60*b* to the anode and cathode connecting portions 61*a*, 61*b* of the anode contact portion 26*a* and the cathode contact portion 27*a* of the light emitting diode (LED) filament structures 25*a*', 25*b*' at the common apex interface A1 that is positioned at the upper surface of the light engine 100*a* depicted in FIG. 1B. Further details of the bend angle α1 that is depicted in FIG. 1B is provided by the description of the bend angle α1 that is depicted in FIG. 1A.

Figure 5C:
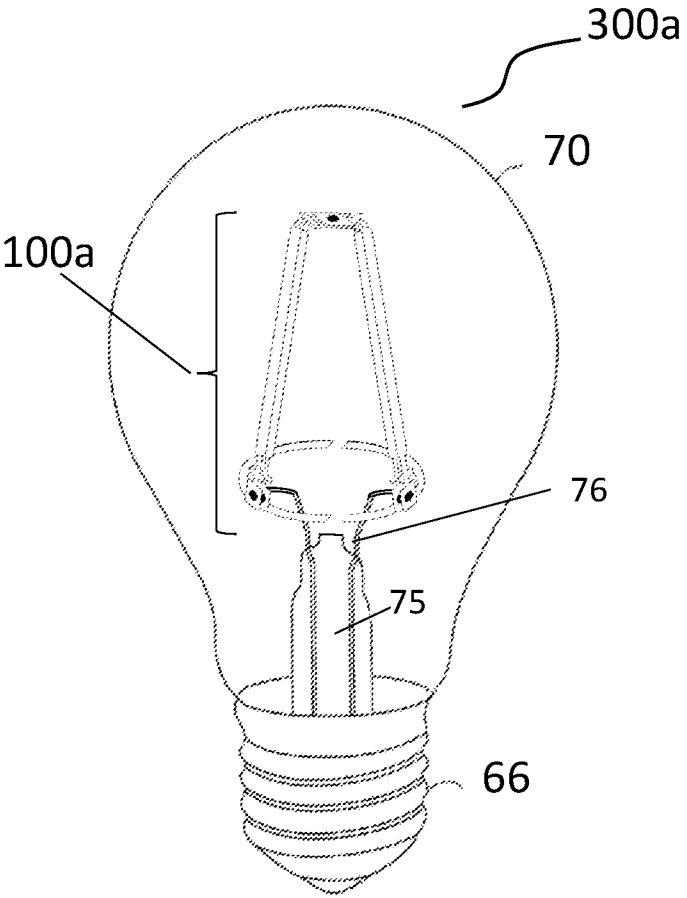
FIG. 5C is perspective view of a lamp including a light engine composed of a plurality of light emitting diode (LED) filament structures as depicted in FIG. 1B, in accordance with one embodiment of the present disclosure.
Figure 5A:
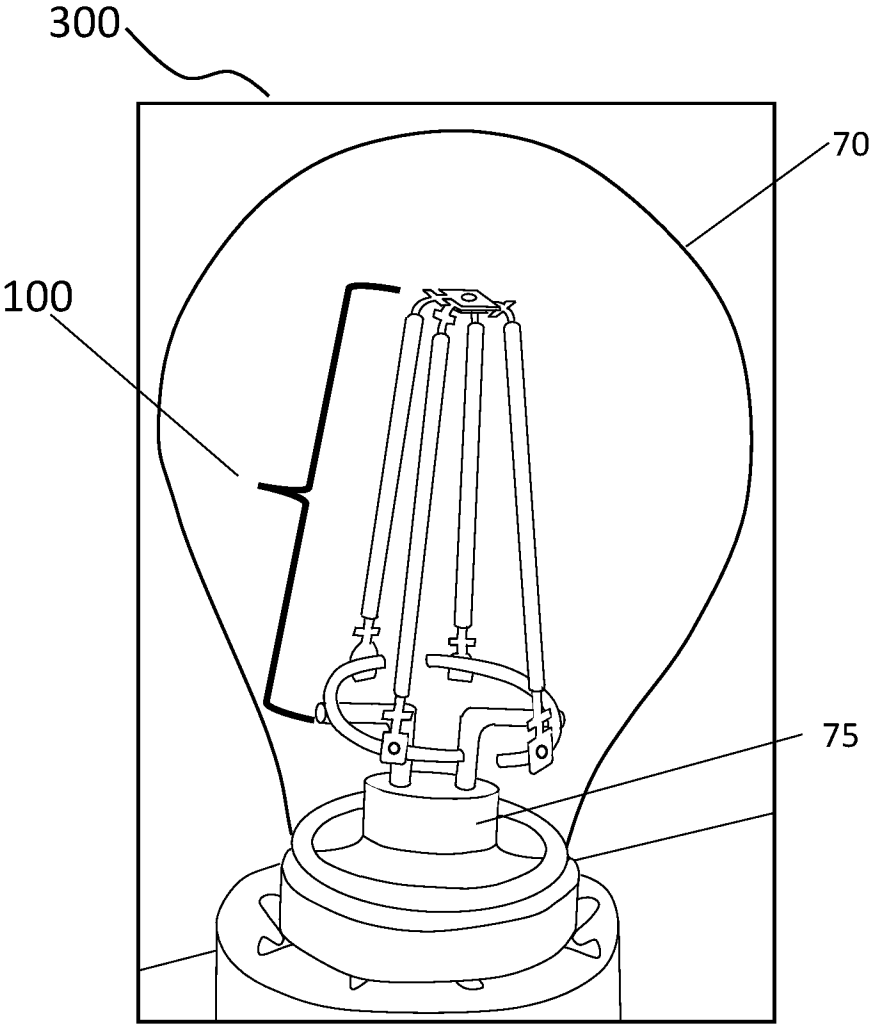
FIG. 5A is a photograph of a lamp including a light engine composed of a plurality of light emitting diode (LED) filament structures as depicted in FIG. 1A, in accordance with one embodiment of the present disclosure.
Figure 5B:
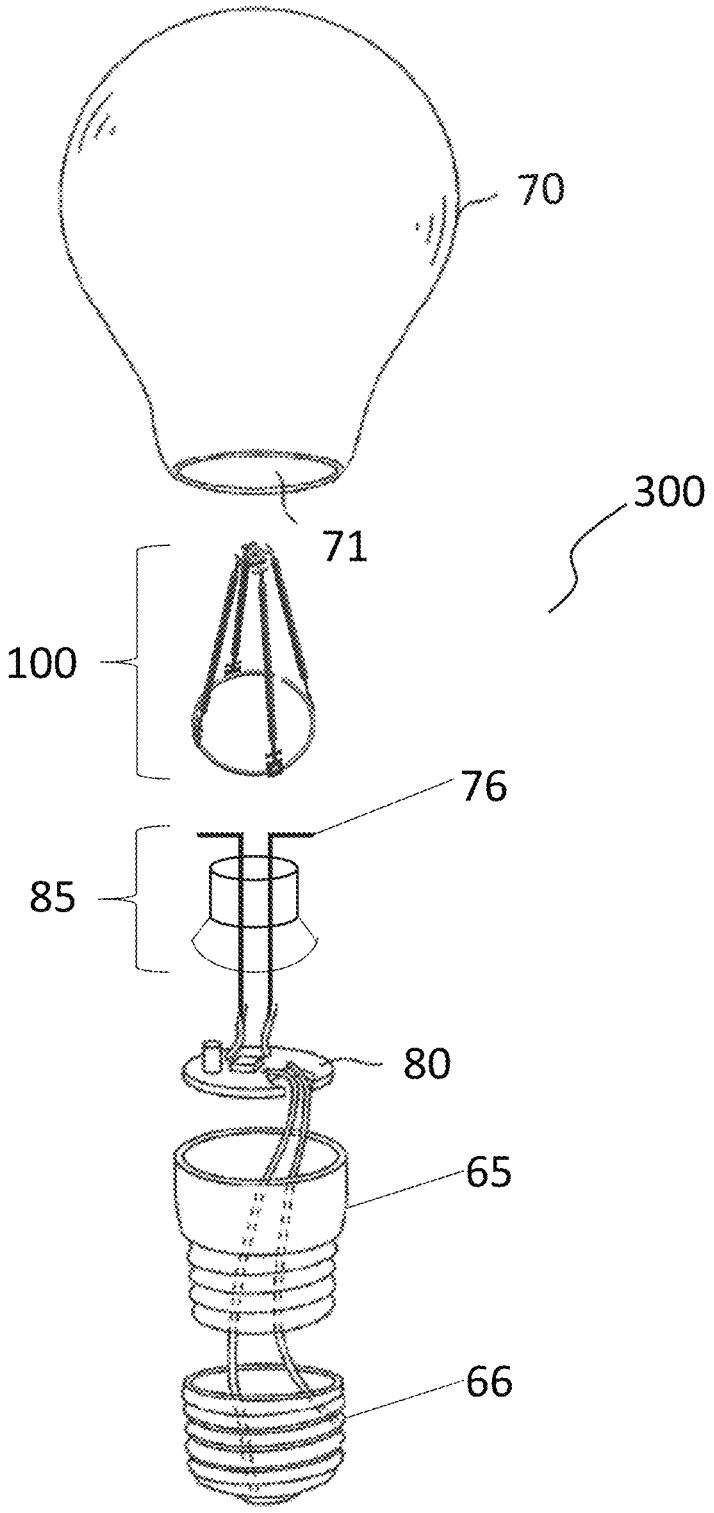
FIG. 5B is an illustration depicting an exploded view of FIG. 5A.

In another aspect, the light engine 100, 100*a* that has been described with reference to FIGS. 1A and 1B, as well as FIGS. 2A-4, is incorporated into a lamp 300, as depicted in FIGS. 5A 5B and 5C. FIG. 5A depicts a lamp 300 including a light engine 100 composed of a plurality of light emitting diode (LED) filament structures, as depicted in FIG. 1A. FIG. 5B is an exploded view of FIG. 5A. FIG. 5C depicts a lamp 300*a* including a light engine 100*a* composed of a plurality of light emitting diode (LED) filament structures, as depicted in FIG. 1B.

In one embodiment, a lamp 300, 300*a* is provide that includes a housing (composed of the globe 70 and base housing 65) including a light projecting end (provided by the globe 70) and a base (provided by the base housing 65) having an electrical connector 66 for connection with a lamp fixture; and a light engine 100, 100*a* positioned with the housing to project light through the light projecting end, i.e., through the globe 70. The light engine 100, 100*a* has been described above with reference to FIGS. 1A-4. For example, the light engine 100, 100*a* can include an anode supporting base contact 50*a* having a first arcular geometry, a cathode supporting base contact 40*b* having a second arcular geometry, and a plurality of light emitting diode (LED) filament structures 25*a*, 25*b*, 25*a*', 25*b*' that are connected. More specifically, in one embodiment, the plurality of light emitting diode (LED) filament structures 25*a*, 25*b*, 25*a*', 25*b*' are connected at a common apex interface A1, wherein at least a first of the plurality of light emitting diode (LED) filament structures 25*a*, 25*b*, 25*a*', 25*b*' has an anode contact 26*a*, 26*b* in electrical communication with the anode supporting base contact 50*a*, and at least a second of the plurality of light emitting diode (LED) filament structures 25*a*, 25*b*, 25*a*', 25*b*' has a cathode contact 27*a*, 27*b* in electrical communication with the cathode supporting base contact 50*b*.

As illustrated in FIGS. 5A-5C, the light bulb shaped lamp 300, 300*a* is a light bulb shaped LED lamp replacing an incandescent electric bulb, in which a base 65 is attached to a translucent globe 70. The light engine 100, 100*a* including the light emitting diode (LED) filament structures 25*a*, 25*b*, 25*a*', 25*b*' is housed in the globe 70. The light engine 100, 100*a* including the light emitting diode (LED) filament structures 25*a*, 25*b*, 25*a*', 25*b*' is directly fixed to the stem 75 extending from an opening 71 of the globe 70 toward the inside of the globe 70. The stem 75 is in electrical communication with driver electronics, e.g., lighting circuit 80, in which the driver electronics are in electrical communication with the portion of the base 65 that engages the lamp fixture.

In some embodiments, the globe 70 is a hollow translucent component, houses the light engine 100, 100*a* inside, and transmits the light from the light engine 100, 100*a* to outside of the lamp 100, 100*a*. In some embodiments, the globe 70 is a hollow glass bulb made of silica glass transparent to visible light. In other embodiments, the globe 70 may be composed of transparent plastic. The globe 70 can have a shape with one end closed in a spherical shape, and the other end having an opening 71. In other words, the shape of the globe 110 is that a part of hollow sphere is narrowed down while extending away from the center of the sphere, and the opening 71 is formed at a part away from the center of the sphere. In the embodiment that is depicted in FIGS. 5A-5C, the shape of the globe 70 is Type A (JIS C7710) which is the same as a common incandescent light bulb. It is noted that this geometry is provided for illustrative purposes only, and is not intended to limit the present disclosure. For example, the shape of the globe 70 may also be Type G, Type E, or others.

The light engine 100, 100*a* that is housed within the globe 70 has been described above with reference to FIG. 1A-4. That description is incorporated herein for describing the light engine 100, 100*a* of the lamp 300 that is described with reference to FIGS. 5A-5C.

The light engine 100, 100*a* is positioned within the globe 70 by connection to the lead wires 76 that are supported by the stem 75. The stem 75 is a pillar extended toward the inside of the globe 70. The anode and cathode contact supporting base portions 50*a*, 50*b* are directly fixed to the ends of the lead wires 76 that extend through the stem 75. In some embodiments, the stem structure 75 is positioned between the light engine 100, 100*a* and the driver electronics, wherein connection between the light engine 100, 100*a* and the driver electronics 80 includes wire lead wires 76 including a first L-shaped contact to the anode supporting base contact 50*a* having the first arcular geometry, and a second L-shaped contact to the cathode supporting base contact 50*b* having the second arcular geometry.

In some embodiments, the other end portion of the stem 75 includes a flared shape that can be coinciding with the shape of the opening 71. The other end portion of the stem 75 can be formed in the flared shape to be joined with the opening 71 of the globe 70 so as to close the opening of the globe 70. In other embodiments, the flared shape of the stem 75 may engage a first surface of the base housing 65 and the globe 70 may contact a second separate surface of the base housing 65, wherein between the base housing 65, the globe 70 and the flared end portion of the step 75, a sealed structure is provided. In addition, parts of two lead wires 76 can be partially sealed in the stem 75. Accordingly, it is possible to supply power to the light engine 100, 100*a* in the globe 70 from outside of the globe 70 keeping the globe 70 airtight. Accordingly, the light bulb shaped lamp 300 can prevent water or water vapor from entering the globe 70 for a long period of time, and it is possible to suppress the degradation of the light engine 100, 100*a* and a part connecting the light engine 100, 100*a* and the lead wire 76 due to moisture.

The stem 75 can be made of soft glass transparent to visible light. This structure of the light bulb shaped lamp 300 suppresses loss of light from the light engine 100, 100*a* by the stem 75. In addition, the light bulb shaped lamp 300 can prevent the shadow cast by the stem 75. Furthermore, light emitted by the light engine 100, 100*a* can light up the stem 75. Note that, it is not necessary for the stem 75 to be transparent to the visible light, or to be made of soft glass. For example, the stem 75 may be a component made of a highly heat-conductive resin. As the highly heat-conductive resin, silicone resin in which metal particles such as alumina or zinc oxide are mixed may be used.

Two lead wires 76 support the light engine 100, 100*a*, and hold the light engine 100, 100*a*, at a constant position in the globe 70. The power supplied from the base 66 of the base housing 65 is supplied to the light engine 100, 100*a* through the two lead wires 76. Each of the lead wires 65 may be a composite wire including an internal lead wire, a Dumet wire (copper-clad nickel steel wire) and an external lead wire joined in this order.

The internal lead wire is the electric wire extending from the stem 75 to the light engine 100, 100*a*, and supporting the light engine 100, 100*a* through engagement to the anode and cathode contact supporting base portions 50*a*, 50*b*. The Dumet wire is sealed in the stem 75. The external lead wire is an electric wire extending from the driver electronics 80, e.g., lighting circuit, to the stem 75. In some embodiments, the lead wires 76 are a metal wire including copper having high thermal conductivity. With this, the heat generated at the light engine 100, 100*a* can be actively transferred to the base housing 65 through the lead wire 76. It is noted that the lead wires 76 do not necessarily have to be a composite wire, and may be a single wire made of the same metal.

In one embodiment, the driver electronics 80, e.g., lighting circuit, is a circuit for causing the LEDs of the plurality of light emitting diode (LED) filament structures 25*a*, 25*b*, 25*a*', 25*b*' to emit light, and is housed in the base housing 65. More specifically, the driver electronics 80, e.g., lighting circuit, includes a plurality of circuit elements, and a circuit board on which each of the circuit elements is mounted. In this embodiment, the driver electronics 80, e.g., lighting circuit, converts the AC power received from the base 66 of the base housing 65 to the DC power, and supplies the DC power to the LEDs of the plurality of light emitting diode (LED) filament structures 25*a*, 25*b*, 25*a*', 25*b*' through the two lead wires 76. In one embodiment, the driver electronics 80 is a lighting circuit that may include a diode bridge for rectification, a capacitor for smoothing, and a resistor for adjusting current. The lighting circuit is not limited to a smoothing circuit, but may be an appropriate combination of light-adjusting circuit, voltage booster, and others.

The driver electronics 80 may be housed within a base housing 65 that is composed of a resin material. The base housing 65 can be provided at the opening 71 of the globe 70. More specifically, the base housing 65 is attached to the globe 70 using an adhesive such as cement to cover the opening 71 of the globe 70.

The base 66 is connected to the end of the base housing 65 that is opposite the end of the base housing 65 that is closest to the globe 70. In the embodiment that is depicted in FIGS. 5A-5C, the base 66 is an E26 base. The light bulb shaped lamp 300 can be attached to a socket for E26 base connected to the commercial AC power source for use. Note that, the base 66 does not have to be an E26 base, and may be a base of other size, such as E17. In addition, the base 66 does not have to be a screw base, and may be a base in a different shape such as a plug-in base.

In yet another aspect, a method of forming the light engine 100, 100*a* depicted in FIGS. 1A and 1B is provided. Broadly, the method may include positioning a supporting ring (also referred to as snap ring 45) for the light source on a ring positioning base surface 87 of the mandrel welding electrode 85; and positioning at least two light emitting diode filament structures 25*a*, 25*b*, 25*a*', 25*b*' that are joined at a weldment at a first electrode end of the at least two light emitting diode filament structures 25*a*, 25*b*, 25*a*', 25*b*' on a centering surface at first end of the mandrel welding electrode 85. The ring positioning base surface 87 is present at an opposing second end of the mandrel welding electrode 85. The method may continue with joining each of the second electrode end for the filament light emitting diodes of the at least two light emitting diode (LED) filament structures to the supporting ring of the light source. The supporting ring may be sectioned to provide portions that are separately in contact with anode contacts and cathode contacts of the at least two light emitting diode (LED) filament structures.

Figure 6:
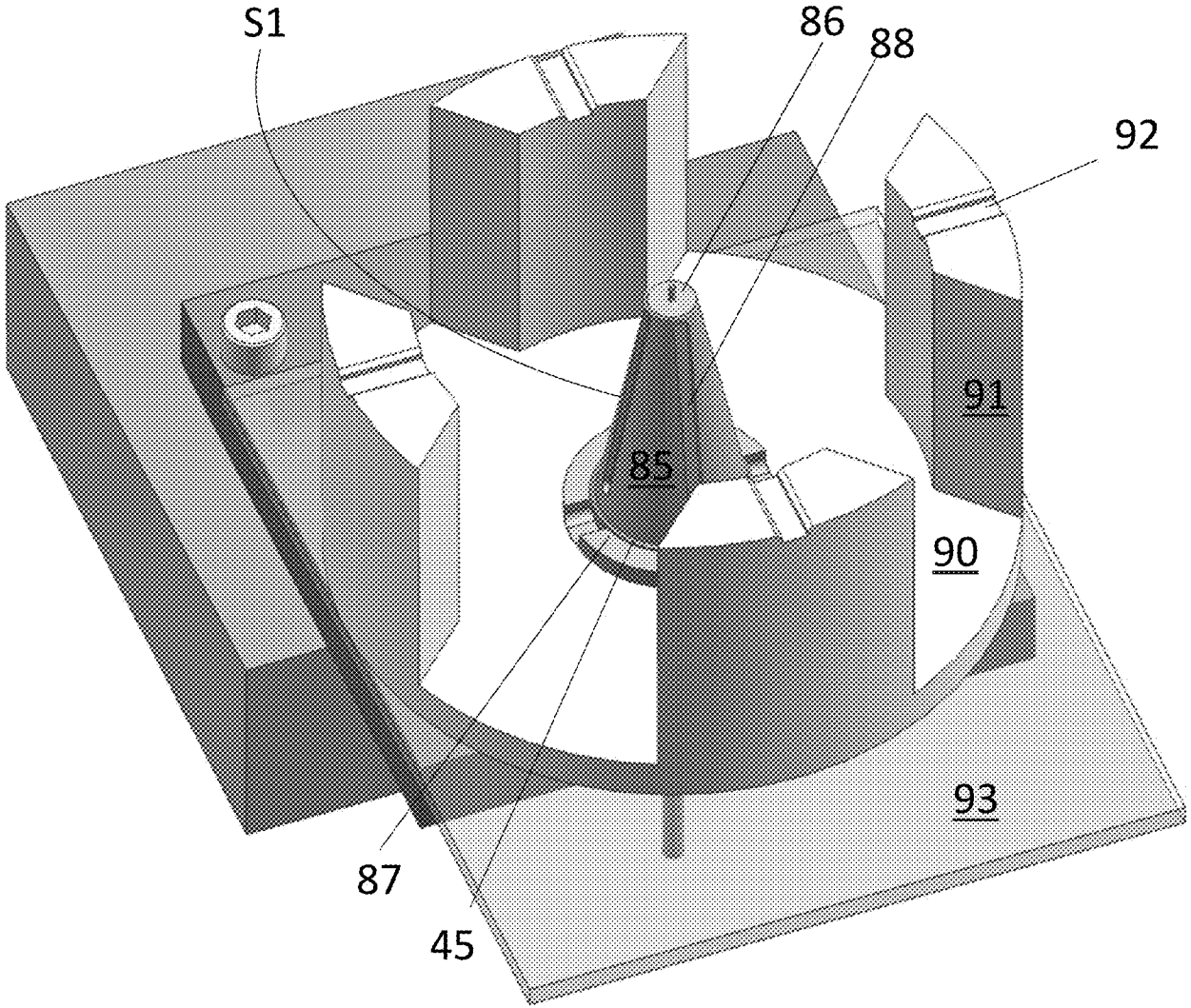
FIG. 6 is a perspective view of a mandrel welding electrode positioned in a base structure having a plurality of perimeter supporting pedestals, and positioning a supporting ring for the light engine on a ring positioning base surface of the first welding electrode, in accordance with one embodiment of a method for forming light engines including a cone like style assembly of light emitting diode (LED) filaments.

One example of a method for forming the light engine 100, 100*a* depicted in FIGS. 1A and 1B is described with reference to FIGS. 6-11C. Referring to FIG. 6, the method may include positioning a mandrel welding electrode 85 in a base structure 90 having a plurality of perimeter supporting pedestals 91. The mandrel welding electrode 85 may include a centering surface 86 at a first end of the mandrel welding electrode 85 and a ring positioning base surface 87 at a second end of the mandrel welding electrode 85. In one embodiment, the mandrel welding electrode 85 is composed of a welding electrode material, such as copper or a copper containing alloy. In the embodiments, in which a copper containing alloy provides the mandrel welding electrode 85, the copper containing alloy includes copper that is alloyed with at least one of manganese, aluminum, silicon, tin, and combinations thereof. In some embodiments, the centering surface 86 of the mandrel welding electrode 85 includes a centering pin. The centering pin of the centering surface 86 for the mandrel welding electrode 85 may have a dimension for engaging an opening in the frame structure portion 60*a*, 60*b* of the light emitting diode (LED) filament structures 25*a*, 25*b*, 25*a*', 25*b*'. In some embodiments, the ring positioning base surface 87 of the mandrel welding electrode 85 may include a slot, e.g., recess, that is present in the sidewall of the base of the mandrel welding electrode, in which the slot for the ring positioning base surface 87 has dimensions for engaging a snap ring 45. One example of the snap ring 45 to be engaged by the slot for the ring positioning base surface 87 is depicted in FIG. 5, and is processed to provide the anode and cathode contact supporting base portions 50*a*, 50*b*.

In some embodiments, the mandrel welding electrode 85 includes a planar upper surface for the centering surface 86 and a tapered sidewall S1 extending from the planar upper surface to the ring positioning base surface 87, wherein a transition between the planar upper surface and the tapered sidewall S1 provides a deformation surface with a bending angle $\alpha$1. As will be described in greater detail below, the bending angle $\alpha$1 provides that during the deformation of the at least two light emitting diode (LED) filament structures 25*a*, 25*b*, 25*a*', 25*b*' during the formation of the light engine 100, 100*a*, the second electrode end contacts the supporting ring. In some embodiments, the tapered sidewall S1 of the mandrel welding electrode 85 includes recesses having dimensions for housing the light emitting diode (LED) filament structures 25*a*, 25*b*, 25*a*', 25*b*' during the deformation steps that are employed to produce the light engine 100, 100*a*.

The plurality of perimeter supporting pedestals 91 of the base structure 90 supports the ends of the light emitting diode (LED) filament structures 25*a*, 25*b*, 25*a*', 25*b*' opposite the ends of the light emitting diode (LED) filament structures 25*a*, 25*b*, 25*a*', 25*b*' that are positioned on the centering surface 86. The number of perimeter supporting pedestals 91 is equal to the number of light emitting diode (LED) filament structures 25*a*, 25*b*, 25*a*', 25*b*'. For example, in the embodiment that is depicted in FIG. 6, there are four light emitting diode (LED) filament structures 25*a*, 25*b*, 25*a*', 25*b*', and there are four perimeter supporting pedestals 91. In other examples, the number of perimeter supporting pedestals 91 may be equal to 2, 3, 4, 5, 6, 7, 8, 9 and 10, as well as any range for the number of perimeter supporting pedestals 91 including one of the aforementioned examples as a lower limit of the range, and one of the aforementioned examples as an upper limit of the range. In some embodiments, the perimeter supporting pedestals 91 are positioned encircling the centering surface 86 of the mandrel welding electrode 85. In some embodiments, each of the supporting pedestals 91 of the base structure 90 may be separated by a space. As will be described below, the space between the adjacent supporting pedestals 91 allows for the base structure 90 to be rotated to remove support for the ends of the light emitting diode (LED) filament structures 25*a*, 25*b*, 25*a*', 25*b*' during the deformation step, as will be described in greater detail below with reference to FIGS. 9-10B. In some embodiments, the upper surface of the supporting pedestals 91 includes a retaining slot 92. The retaining slot 92 similar to the centering surface 86 has a geometry for retaining the frame portions 60*a*, 60*b* of the anode and cathode contact portions 26*a*, 27*a*. The base structure 90 may be composed of a metal or plastic material.

Still referring to FIG. 6, in some embodiments, the method may include positioning a supporting ring 45 for the light engine 100, 100*a* on the ring positioning base surface 87 of the mandrel welding electrode 85. The snap ring 45 have a relief that is cut in its diameter. The dimensions of the snap ring 45, the tapered sidewall S1 of the mandrel forming electrode 85, and the dimensions of the slot at the ring positioning base surface 87 provides that the snap ring engages the slot.

Figure 7:
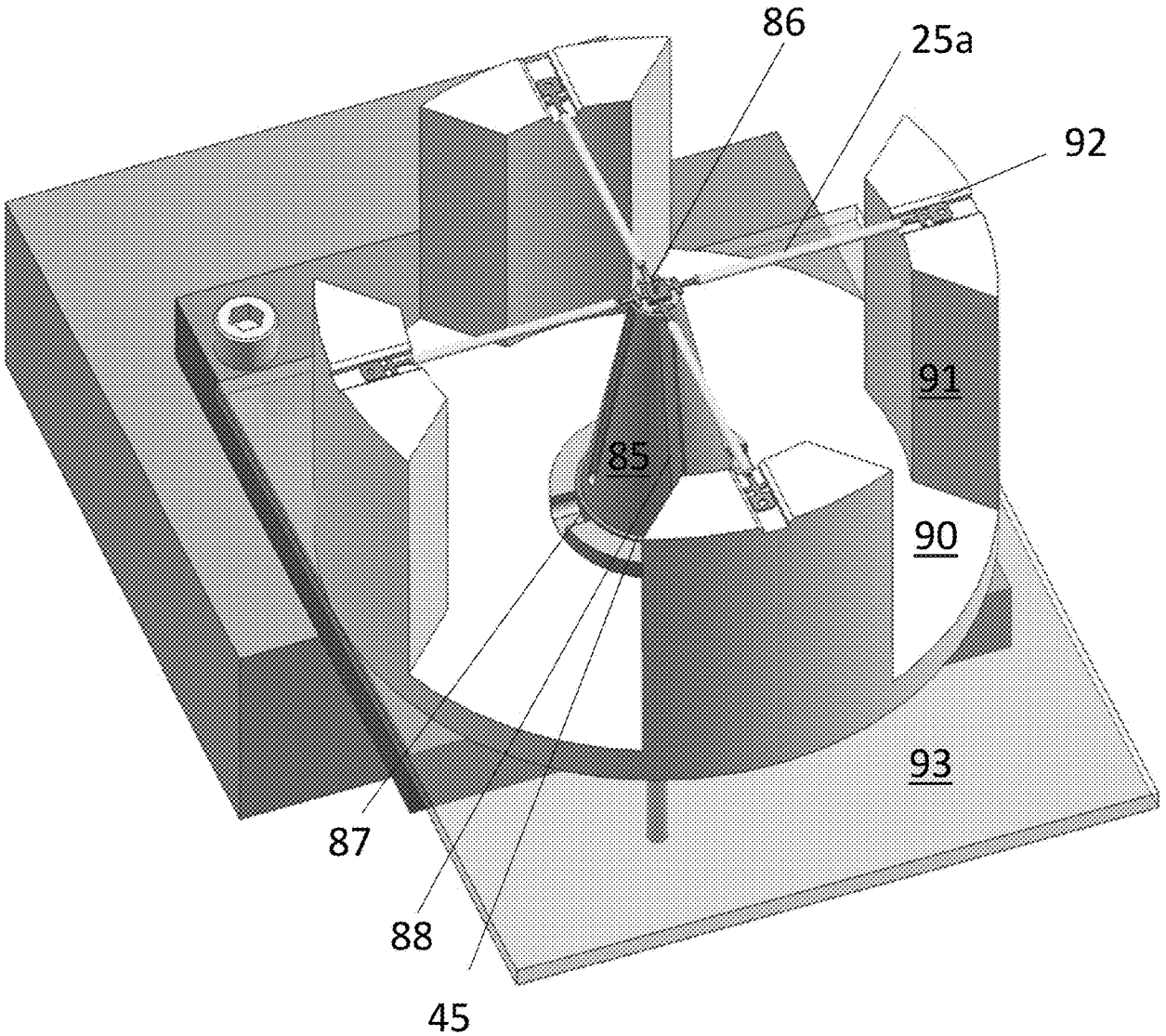
FIG. 7 is a perspective view depicting positioning at least two light emitting diode (LED) filament structures on the mandrel welding electrode and the base structure, wherein for the filament light emitting diodes a first electrode end is positioned on the centering surface of the mandrel welding electrode and a second electrode end is positioned on one of said plurality of perimeter supporting pedestals of the base structure, in accordance with one embodiment of the present disclosure.

FIG. 7 depicts positioning at least two light emitting diode (LED) filament structures 25*a*, 25*b*, 25*a*', 25*b*' on the mandrel welding electrode 85 and the base structure 90, wherein for the filament light emitting diodes 25*a*, 25*b*, 25*a*', 25*b*' a first electrode end (provided by one of the anode contact 26*a*, 26*b* or the cathode contact 27*a*, 27*b*) is positioned on the centering surface 86 of the mandrel welding electrode 85, and a second electrode end (provided by the other of the anode contact 26*a*, 26*b* or the cathode contact 27*a*, 27*b*) is positioned on one of said plurality of perimeter supporting pedestals 91 of the base structure 90. The light emitting diode (LED) filament structures 25*a*, 25*b*, 25*a*', 25*b*' that are depicted in FIG. 7 have been described above with reference to FIG. 2A. For example, in some embodiments, each of the filament light emitting diodes 25*a*, 25*b*, 25*a*', 25*b*' include an anode contact 26*a*, 26*b* at a first end, a cathode contact 27*a*, 27*b* at an opposing second end, a substrate positioned between the anode contact and the cathode contact 26*a*, 26*b*, 27*a*, 27*b*, and a plurality of series connected light emitting diodes present on the substrate and extending from the cathode contact 27*a*, 27*b* to the anode contact 26*a*, 26*b*. For example, the at least two light emitting diode (LED) filament structures are sectioned from a fame assembly of filaments that are connected (to provide that the length of adjacent filaments are parallel to one another as described above with reference to FIG. 3), wherein the anode contacts 26*a*, 26*b* and cathode contacts 27*a*, 27*b* are provided by sectioned portions of the frame structure 60*a*, 60*b* connecting the adjacent filaments in the frame assembly 200. In the embodiments depicted in FIG. 7, the frame structure 60*a*, 60*b* portions of the anode contacts 26*a*, 26*b* and cathode contacts 27*a*, 27*b* are positioned on the centering surface 86 of the mandrel welding electrode 85, and the retaining slot 92 of the upper surface of the supporting pedestals 91 of the base structure 92.

FIG. 7 further depicts a shim 93 that is positioned under the base structure 90. In some embodiments, when the shim 93 is positioned under the base structure, the base of the retaining slot 92 is coplanar with the base of the centering surface 86 of the mandrel welding electrode 85, in which the sidewall of the retaining slot 92 obstruct the frame structure

60*a*, 60*b* portions of the anode contacts 26*a*, 26*b* and cathode contacts 27*a*, 27*b* that are positioned within the retaining slot 92 from being removed. In some embodiments, the first electrode end contact for a first of the light emitting diode (LED) filament structures 25*a*, 25*a*' is a cathode contact 27*a*, and wherein the first electrode end contact for a second of the at least two light emitting diodes 25*b*, 25*b*' is a anode contact 26*b*. These contacts are positioned on the centering surface 86. In some embodiments, the second electrode end contact for the first of the light emitting diode (LED) filament structures 25*a*, 25*a*' is an anode contact 26*a* that is to be connected to the anode supporting base ring 50*a* of the light engine 100, 100*a*, and wherein the second electrode end contact for the second of the at least two light emitting diodes 25*b*, 25*b*' is a cathode contact 27*b* that is to be connected to the cathode supporting base ring 50*b* of the light engine 100, 100*a*. These contacts are positioned on the perimeter pedestals 91 of the base structure 90.

Although FIG. 7 illustrates singular light emitting diode (LED) filaments, as depicted in FIG. 2A, for the light emitting diode (LED) filament structures 25*a*, 25*b* the method that is described with reference to FIGS. 6-11B is equally applicable to light emitting diode (LED) filament structures 25*a*', 25*b* that each include two light emitting diode (LED) filaments that are electrically connected in parallel, as depicted in FIG. 2B.

Figure 8:
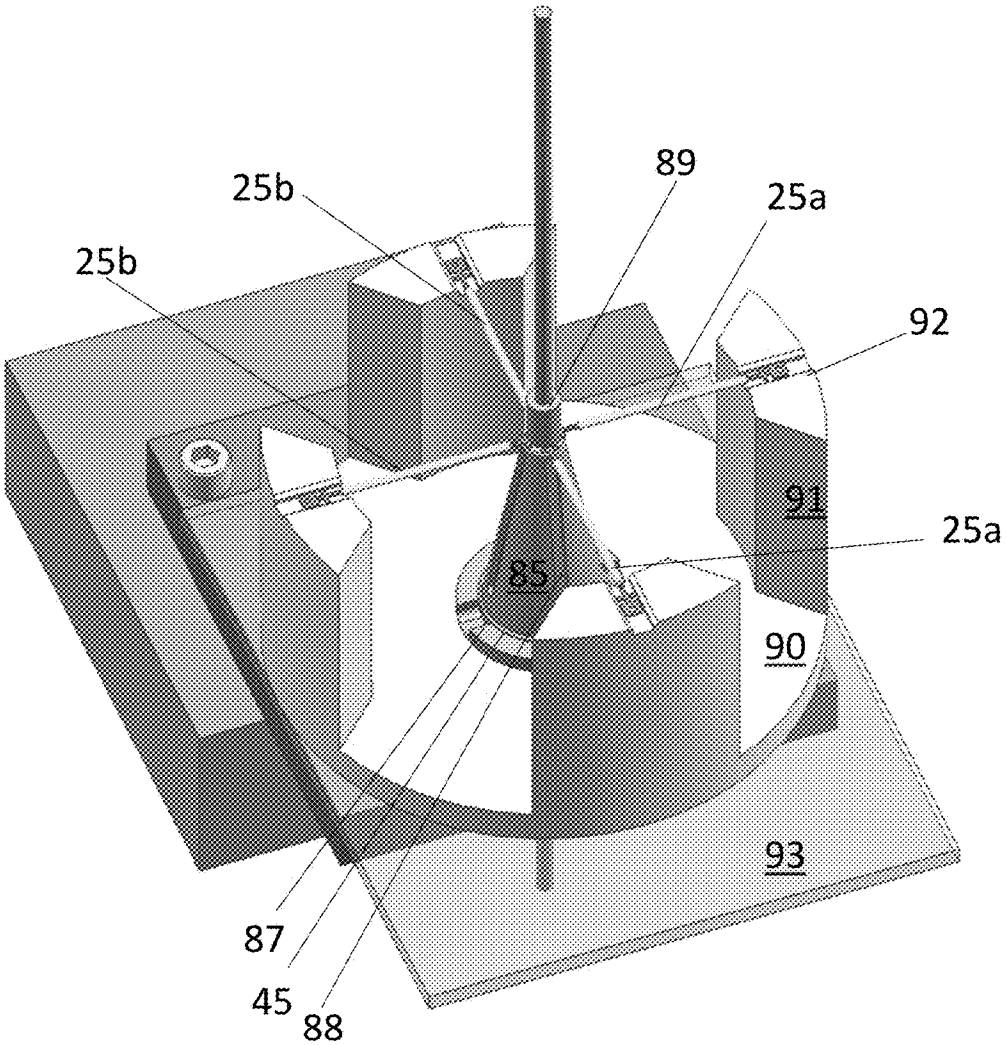
FIG. 8 is a perspective view depicting joining together each of the first electrode end for the filament light emitting diodes of the at least two light emitting diode (LED) filament structures at the centering surface of the mandrel welding electrode, in accordance with one embodiment of the present disclosure.

FIG. 8 depicts joining together each of the first electrode end for the filament light emitting diodes of the at least two light emitting diode (LED) filament structures 25*a*, 25*a*', 25*b*, 25*b*' at the centering surface 86 of the mandrel welding electrode 85. The joining process may be by welding. In one embodiment, the type of welding employed to join the first electrode end for the filament light emitting diodes of the at least two light emitting diode (LED) filament structures 25*a*, 25*a*', 25*b*, 25*b*' at the centering surface 86 of the mandrel welding electrode 85 is electric resistance welding. Electric resistance welding (ERW) refers to a group of welding processes that produce coalescence of faying surfaces, i.e., the overlapping portions of the frame structure 60*a*, 60*b* of the anode contact portion 26*a*, 26*b*, the cathode contact portions 27*a*, 27*b*, and/or the anode and cathode contact supporting base portions 50*a*, 50*b*, where heat to form the weld is generated by the electrical resistance of material combined with the time and the force used to hold the materials together during welding. Some factors influencing heat or welding temperatures are the proportions of the workpieces, the metal coating or the lack of coating, the electrode materials, electrode geometry, electrode pressing force, electrical current and length of welding time. Small pools of molten metal are formed at the point of most electrical resistance (the connecting or "faying" surfaces) as an electrical current is passed through the metal. Referring to FIG. 8, to provide the weldment, i.e., joining of the light emitting diode (LED) filament structures 25*a*, 25*a*', 25*b*, 25*b*' at the centering surface 86 of the mandrel welding electrode 85, a first welding electrode 89 contacts that surfaces of the anode and cathode contact portions 26*a*, 26*b*, 27*a*, 27*b* that are present on the centering surface 86 of the mandrel welding electrode 85. The first welding electrode 89 provides a clamp force to the anode and cathode contact portions 26*a*, 26*b*, 27*a*, 27*b* that are present on the centering surface 86 of the mandrel welding electrode 85. A current is passed from the first welding electrode 89 to the mandrel welding electrode 85 through the anode and cathode contact portions 26*a*, 26*b*, 27*a*, 27*b* of the light emitting diode (LED) filament structures 25*a*, 25*a*', 25*b*, 25*b*' that are present on the centering surface 86, in which the heat caused produced by resistance of the anode and cathode contact portions 26*a*, 26*b*, 27*a*, 27*b* through with the current is passing causes the metal of the anode and cathode contact portions 26*a*, 26*b*, 27*a*, 27*b* to melt, intermix and form a joint. It is noted that the welding method that has been described above is provided for illustrative purposes only, and the present method is not intended to be limited to only this welding method. Other welding methods may also be employed, as well as adhesive engagement and/or soldering methods.

Figure 9:
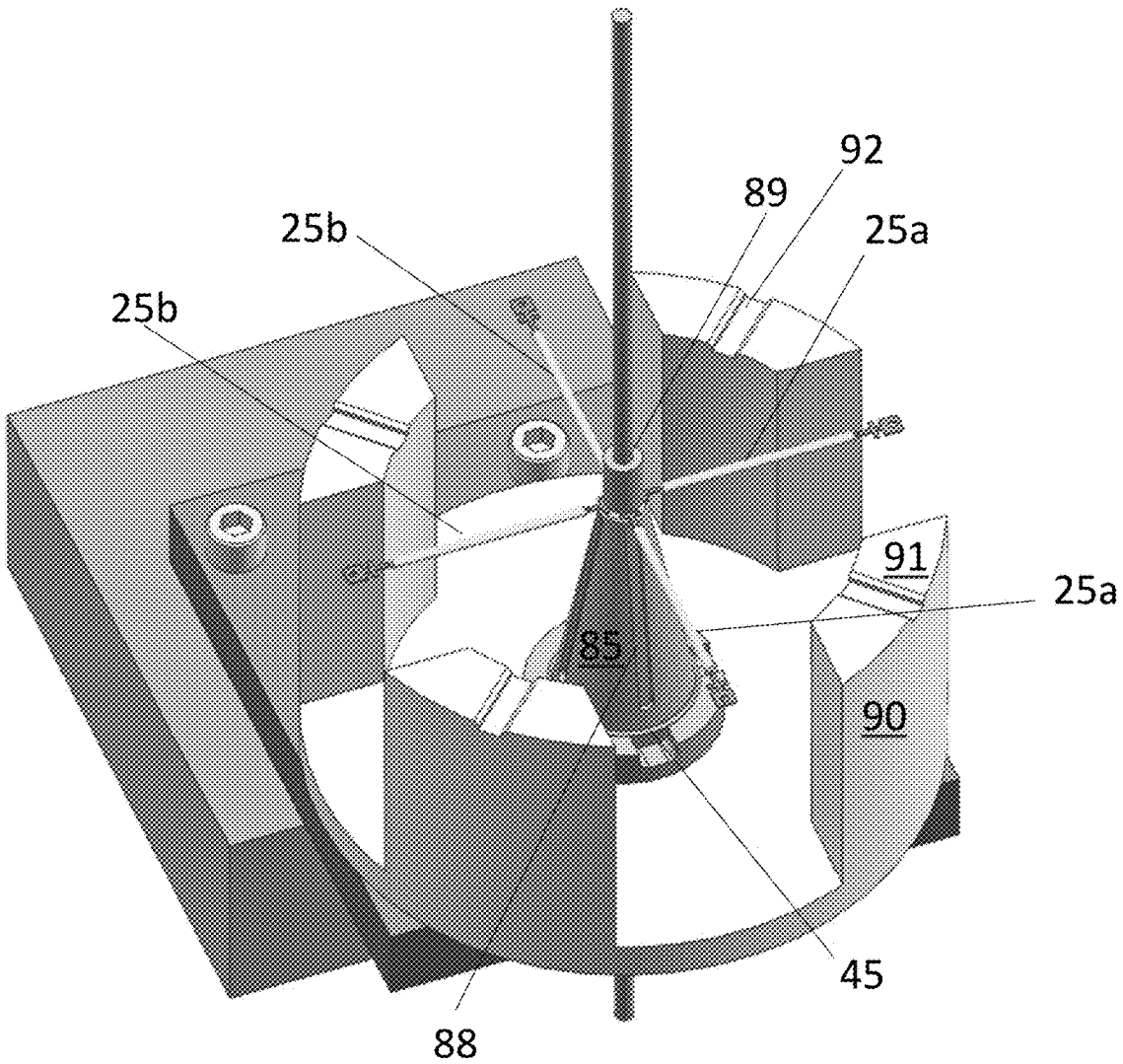
FIG. 9 is a perspective view depicting removing the support to the second electrode end for the filament light emitting diodes of the at light emitting diode (LED) filament structures that was provided by the plurality of perimeter supporting pedestals, in accordance with one embodiment of the present disclosure.

FIG. 9 depicts removing the support to the second electrode end for the filament light emitting diodes 25*a*, 25*a*', 25*b*, 25*b*' of the at light emitting diode (LED) filament structures that was provided by the plurality of perimeter supporting pedestals 91. In some embodiments, removing the support to the second electrode end of the light emitting diode (LED) filaments structures 25*a*, 25*a*', 25*b*, 25*b*' can begin with removing the shim 93 from underlying the base structure 90. By removing the base shim 93, the base structure 90 may drop in a vertical direction, and the mandrel forming electrode 85 will remain stationary, because the mandrel forming electrode 85 is separate from the base structure 90 and independently supported. Dropping the base structure 90 causes the connected plurality of perimeter supporting pedestals 91 to also drop. The change in the vertical direction is equal to the thickness of the base shim 93. The change in vertical direction is selected to ensure that when the plurality of perimeter supporting pedestals 91 drop, the dropped distance is sufficient to ensure that the second electrode ends of the light emitting diode (LED) filaments structures 25*a*, 25*a*', 25*b*, 25*b*' is removed from the slot 92 in the plurality of perimeter supporting pedestals 91. In some embodiments, the first ends of the light emitting diode (LED) filaments structures 25*a*, 25*a*', 25*b*, 25*b*' are still retained on the centering surface 86 of the mandrel forming electrode 85 by the first welding electrode 89, while the base shim 83 is removed, and the base structure 90 drops.

Still referring to FIG. 9, after the base structure 90 drops removing support from the perimeter supporting pedestals 9 the base structure 90 is rotated relative to the stationary mandrel forming electrode 85 to position the second ends of the light emitting diode (LED) filaments structures 25*a*, 25*a*', 25*b*, 25*b*' in the space between adjacent perimeter supporting pedestals 91. In other embodiments, either the mandrel forming electrode 85 or the light emitting diode (LED) filaments structures 25*a*, 25*a*', 25*b*, 25*b*' are rotated relative to the stationary perimeter supporting pedestals 9 to position the second ends of the light emitting diode (LED) filaments structures 25*a*, 25*a*', 25*b*, 25*b*' in the space between adjacent perimeter supporting pedestals 91.

Figure 10A:
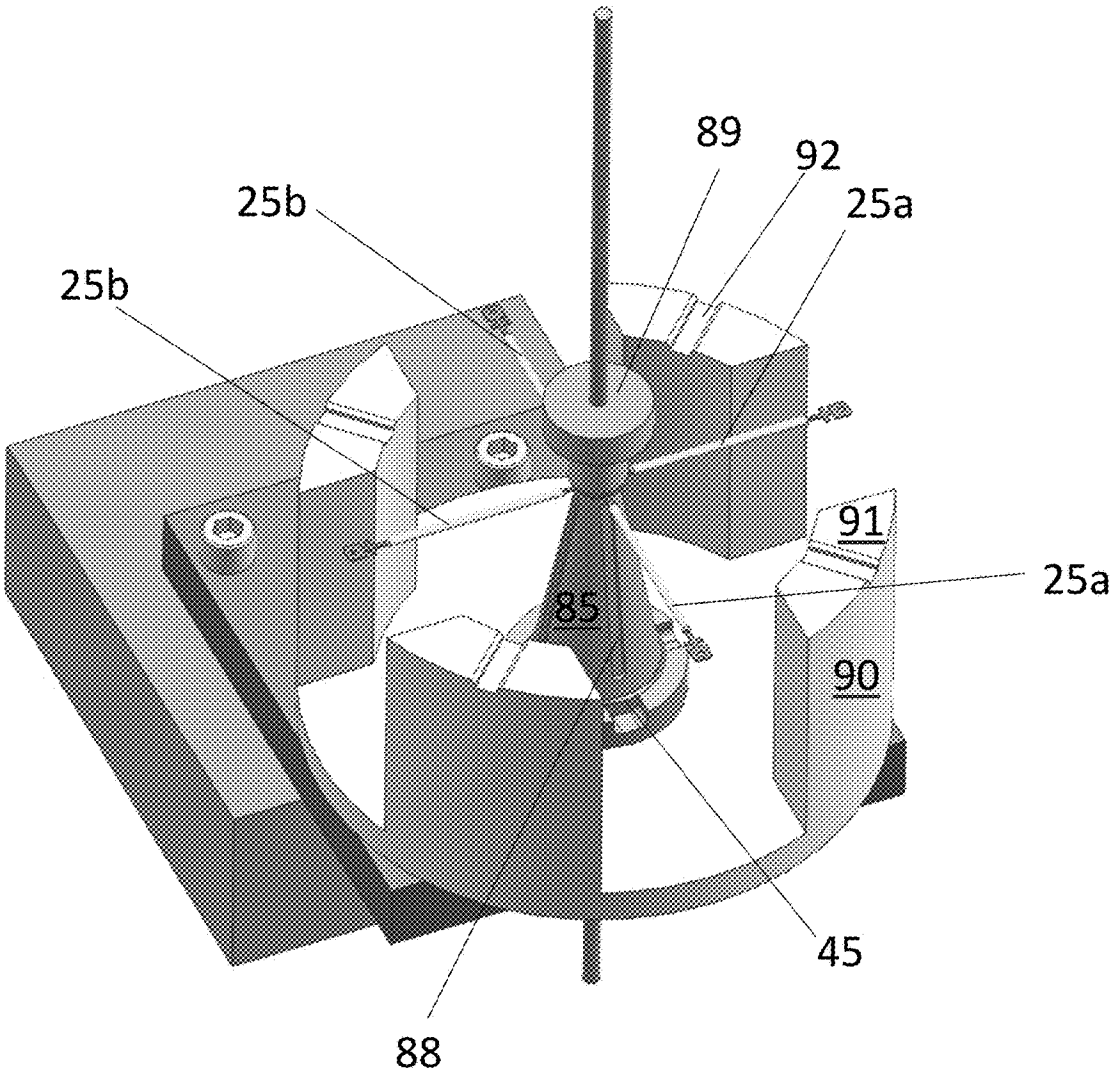
FIG. 10A is a perspective view depicting of a filament flange bending tool contacting the portion of the filament light emitting diodes that is present on the planar upper surface of the mandrel welding electrode, in accordance with one embodiment of the present disclosure.
Figure 10B:
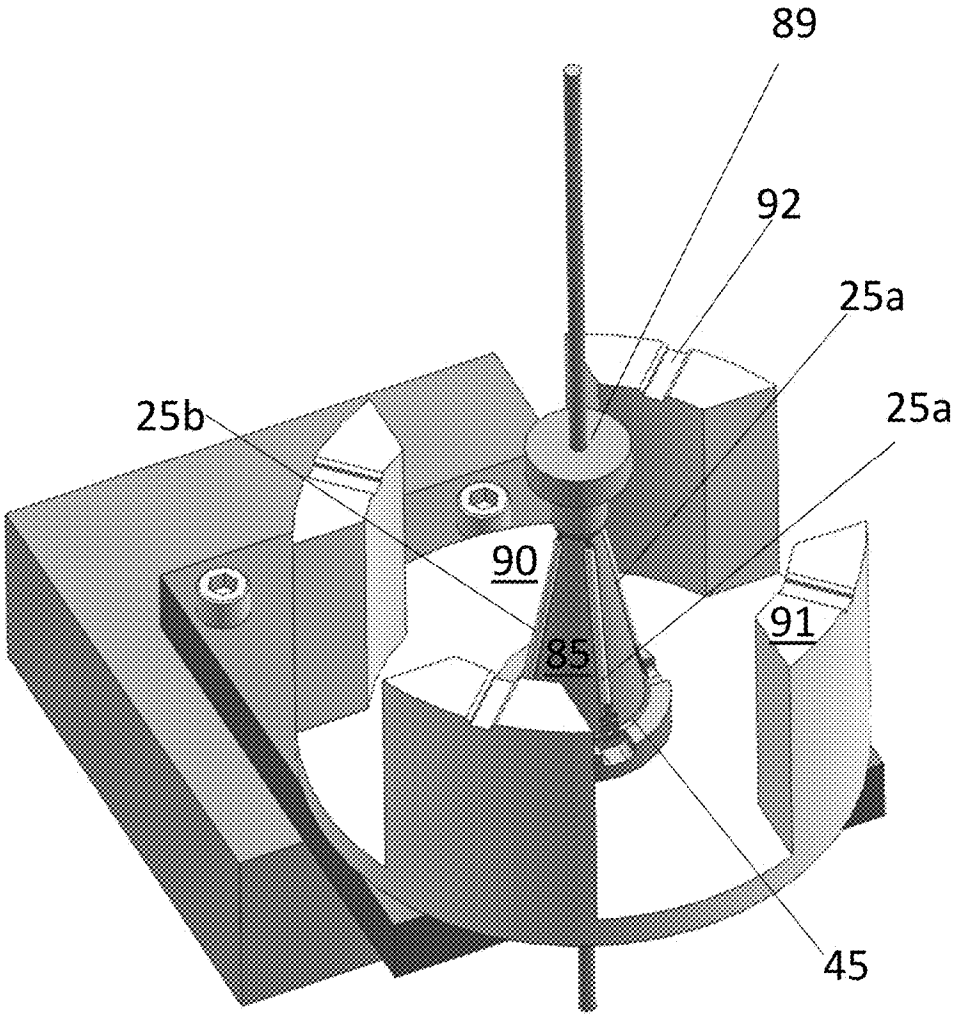
FIG. 10B is a perspective view depicting at least two light emitting diode (LED) filament structures being deformed by the filament flange bending tool to provide that the second electrode end contacts the supporting ring for the light source at the second end of the mandrel welding electrode.

FIGS. 10A to 10B depict one embodiment of deforming the at least two light emitting diode (LED) filament 25*a*, 25*a*', 25*b*, 25*b*' to provide that the second electrode end contacts the supporting ring, i.e., snap ring 45 that is further processed to provide the anode supporting base contact 50*a* having the first arcular geometry and the cathode supporting base contact 50*b* having the second arcular geometry, for the light engine 100, 100*a* at the second end of the mandrel welding electrode 85.

FIG. 10A depicts of a filament flange bending tool 95 contacting the portion of the filament light emitting diodes 25*a*, 25*a*', 25*b*, 25*b*' that is present on the planar upper surface (including the centering surface 86) of the mandrel welding electrode 85. During deforming the light emitting diode (LED) filament structures to provide that the second electrode end contacts the supporting ring, i.e., snap ring 45 that is further processed to provide the anode supporting base contact 50*a* having the first arcular geometry and the cathode supporting base contact 50*b* having the second arcular geometry, a filament flange bending tool 95 presses the light emitting diode (LED) filament structures 25*a*, 25*a*', 25*b*, 25*b*' into contact with the deformation surface of the mandrel welding electrode 85.

The filament flange bending tool 95 has an interior surface having a contour that presses the first end of the light emitting diode (LED) filament structures 25*a*, 25*a*', 25*b*, 25*b*' at the deformation surface that is present at the transition between the planar upper surface and the tapered sidewall S1 of the mandrel welding electrode 85 that provides the deformation surface of the mandrel welding electrode 85. In some embodiments, the contour of the interior surface of the filament flange bending tool 95 substantially matches the deformation surface that is present at the transition between the planar upper surface and the tapered sidewall S1 of the mandrel welding electrode 85. In some embodiments, the matching contour of the filament flange bending tool 95 and the deformation surface of the mandrel welding electrode 85 provides that the first end of the light emitting diode (LED) filament structures 25*a*, 25*a*', 25*b*, 25*b*' positioned between the matching contour of the filament flange bending tool 95 and the deformation surface of the mandrel welding electrode 85 produces the bending angle $\alpha$1 in the light emitting diode (LED) filament structures 25*a*, 25*a*', 25*b*, 25*b*' that provides that the second end of the light emitting diode (LED) filament structures 25*a*, 25*a*', 25*b*, 25*b*' contacts the snap ring 45, i.e., the snap ring 45 that is further processed to provide the anode supporting base contact 50*a* and the cathode supporting base contact 50*b*, as depicted in FIG. 10B. FIG. 10B further depicts that in some embodiments, the light emitting diode (LED) filament structures 25*a*, 25*b*, 25*a*', 25*b*' are positioned within the recesses 88 that are present in the tapered sidewall S1 of the mandrel welding electrode 85, when the second end of the light emitting diode (LED) filament structures 25*a*, 25*a*', 25*b*, 25*b*' contacts the snap ring 45.

FIG. 10B depicts light emitting diode (LED) filament structures 25*a*, 25*a*', 25*b*, 25*b*' deformed by the filament flange bending tool 95 to provide that the second electrode end, e.g., frame portions 60*a*, 60*b* of the anode and cathode contact portions 26*a*, 26*b*, 27*a*, 27*b*, contacts the supporting ring 45 for the light engine 100 at the second end of the mandrel welding electrode 85. FIG. 10B further depicts joining each of the second electrode end for the filament light emitting diodes of the at least two light emitting diode (LED) filament structures to the supporting ring, i.e., snap ring 45, of the light source. The snap ring 45 is further processed to provide the anode supporting base contact 50*a* having the first arcular geometry and the cathode supporting base contact 50*b* having the second arcular geometry, for the light engine 100, 100*a*. The joining process may be by welding. In one embodiment, the type of welding employed to join the second electrode end for the filament light emitting diodes of the at least two light emitting diode (LED) filament structures 25*a*, 25*a*', 25*b*, 25*b*' to the snap ring 45 is electric resistance welding.

Referring to FIG. 10B, to provide the weldment, i.e., joining of the light emitting diode (LED) filament structures 25*a*, 25*a*', 25*b*, 25*b*' to the snap ring 45 at the base of the mandrel welding electrode 85, a second welding electrode (not depicted) contacts that surfaces of the anode and cathode contact portions 26*a*, 26*b*, 27*a*, 27*b* that are present on the snap ring 45 at the base of the mandrel welding electrode 85. The second welding electrode provides a clamp force to the anode and cathode contact portions 26*a*, 26*b*, 27*a*, 27*b* that are present on the snap ring 45 at the base of the mandrel welding electrode 85. A current is passed from the second welding electrode to the mandrel welding electrode 85 through the anode and cathode contact portions 26*a*, 26*b*, 27*a*, 27*b*, e.g., through the frame supporting portions 60*a*, 60*b*, of the light emitting diode (LED) filament structures 25*a*, 25*a*', 25*b*, 25*b*' that are present on the snap ring 45 that is present at the base of the mandrel welding electrode 85, in which the heat caused produced by resistance of the anode and cathode contact portions 26*a*, 26*b*, 27*a*, 27*b* through with the current is passing causes the metal of the anode and cathode contact portions 26*a*, 26*b*, 27*a*, 27*b* to melt, intermix and form a joint. It is noted that the welding method that has been described above is provided for illustrative purposes only, and the present method is not intended to be limited to only this welding method. Other welding methods may also be employed, as well as adhesive engagement and/or soldering methods.

Following joining of the second end of the light emitting diode (LED) filament structures 25*a*, 25*a*', 25*b*, 25*b*' to the snap ring 45, the light engine structure composed of the light emitting diode (LED) filament structures 25*a*, 25*a*', 25*b*, 25*b*' may be removed from the mandrel welding electrode 85.

Figure 11C:
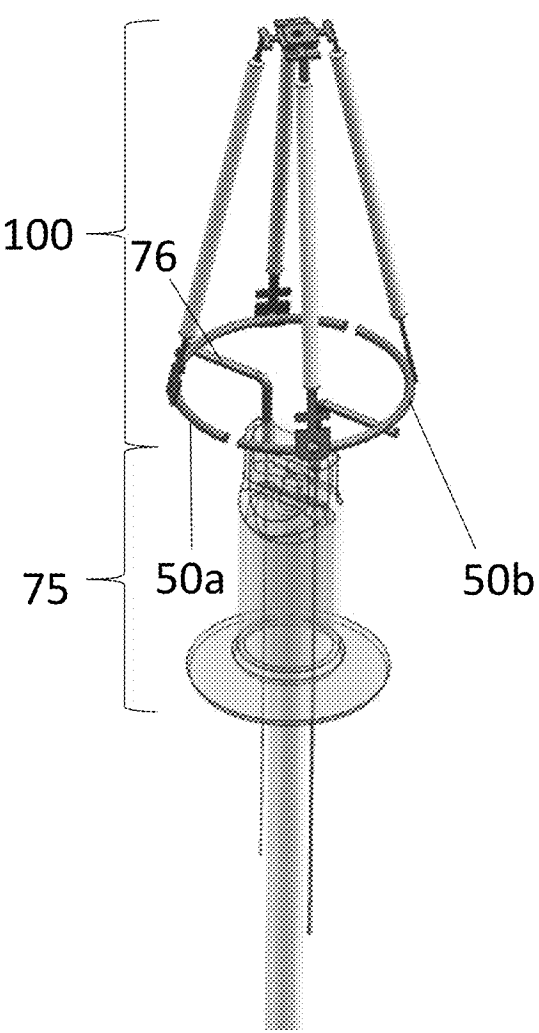
FIG. 11C is a perspective view depicting sectioning the C-ring to provide an anode supporting base contact having a first arcular geometry, and a cathode supporting base contact having a second arcular geometry.
Figure 11B:
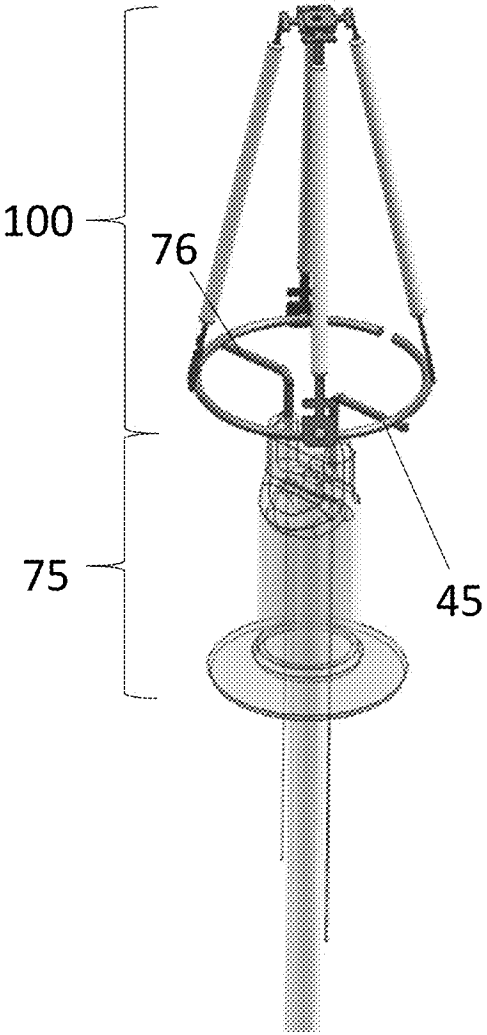
FIG. 11B is a perspective view of joining the light engine described with reference to FIGS. 1A-10B to the stem depicted in FIG. 11A, in accordance with one embodiment of the present disclosure.
Figure 11A:
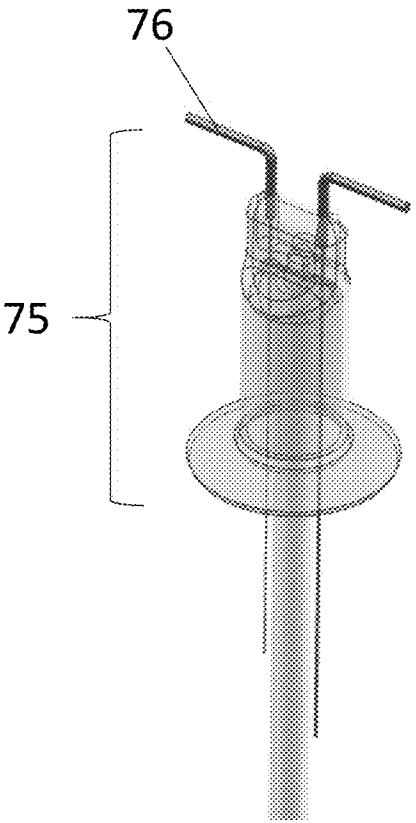
FIG. 11A is a perspective view of one embodiment of a stem for carrying current from the driver electronics of the lamp to the light engine.

FIGS. 11A-11C depict connecting the structure of the snap ring 45 and the connected light emitting diode (LED) filament structures 25*a*, 25*a*', 25*b*, 25*b*' to a stem 75, and sectioning the snap ring 45 to provide the anode supporting base contact 50*a* having the first arcular geometry and the cathode supporting base contact 50*b* having the second arcular geometry, for the light engine 100, 100*a*. FIG. 11A depicts one embodiment of a stem 75 for carrying current from the driver electronics of the lamp to the light engine 100. FIG. 11B depicts one embodiment of joining the light engine 100 described with reference to FIGS. 1A, 2A and 3-10B to the stem depicted in FIG. 11A. The joining process may be by welding. In one embodiment, the type of welding employed to join the lead wires 76 of the stem 75 to the snap ring 45 that is connected to the light emitting diode (LED) filament structures 25*a*, 25*a*', 25*b*, 25*b*' is electric resistance welding.

In some embodiments, at the base of the mandrel welding electrode 85, a second welding electrode (not depicted) contacts that surfaces of the anode and cathode contact portions 26*a*, 26*b*, 27*a*, 27*b* that are present on the snap ring 45 at the base of the mandrel welding electrode 85. The second welding electrode provides a clamp force to the anode and cathode contact portions 26*a*, 26*b*, 27*a*, 27*b* that are present on the snap ring 45 at the base of the mandrel welding electrode 85. A current is passed from the second welding electrode to the mandrel welding electrode 85 through the anode and cathode contact portions 26*a*, 26*b*, 27*a*, 27*b*, e.g., through the frame supporting portions 60*a*, 60*b*, of the light emitting diode (LED) filament structures 25*a*, 25*a*', 25*b*, 25*b*' that are present on the snap ring 45 that is present at the base of the mandrel welding electrode 85, in which the heat caused produced by resistance of the anode and cathode contact portions 26*a*, 26*b*, 27*a*, 27*b* through with the current is passing causes the metal of the anode and cathode contact portions 26*a*, 26*b*, 27*a*, 27*b* to melt, intermix and form a joint. It is noted that the welding method that has been described above is provided for illustrative purposes only, and the present method is not intended to be limited to only this welding method. Other welding methods may also be employed, as well as adhesive engagement and/or soldering methods.

FIG. 11C depicts sectioning the snap ring 45, e.g., C-ring, to provide an anode supporting base contact 50*a* having a first arcular geometry, and a cathode supporting base contact 50*b* having a second arcular geometry.

The method sequence that is described with reference to FIGS. 6-11C is only one example of a process sequence to provide the structure that is depicted in FIGS. 1-5B. For example, the weldment that connects the first electrode end of the light emitting diode (LED) filament structures 25*a*, 25*a*', 25*b*, 25*b*' does not necessarily have to be performed on the mandrel welding electrode 85. In some examples, the weldment that connects the first electrode end of the light emitting diode (LED) filament structures 25*a*, 25*a*', 25*b*, 25*b*' may be performed using equipment that is separate from the mandrel welding electrode 85. In some examples, separating the welding stage that joins the first electrode ends that ultimately provide the common apex A1 of the light source from the welding stage that engages the second electrode ends of the light emitting diode (LED) filament structures 25*a*, 25*a*', 25*b*, 25*b*' to the support ring 45 can enhance manufacturing speed and/or manufacturing automation. One example, of a process sequence that separates the welding stage that joins the first electrode ends of the light emitting diode (LED) filament structures 25*a*, 25*a*', 25*b*, 25*b*' that ultimately provide the common apex A1 of the light source from the welding stage that engages the second electrode ends of the light emitting diode (LED) filament structures 25*a*, 25*a*', 25*b*, 25*b*' to the support ring 45 is illustrated in the flow chart depicted in FIG. 12.

Figure 12:
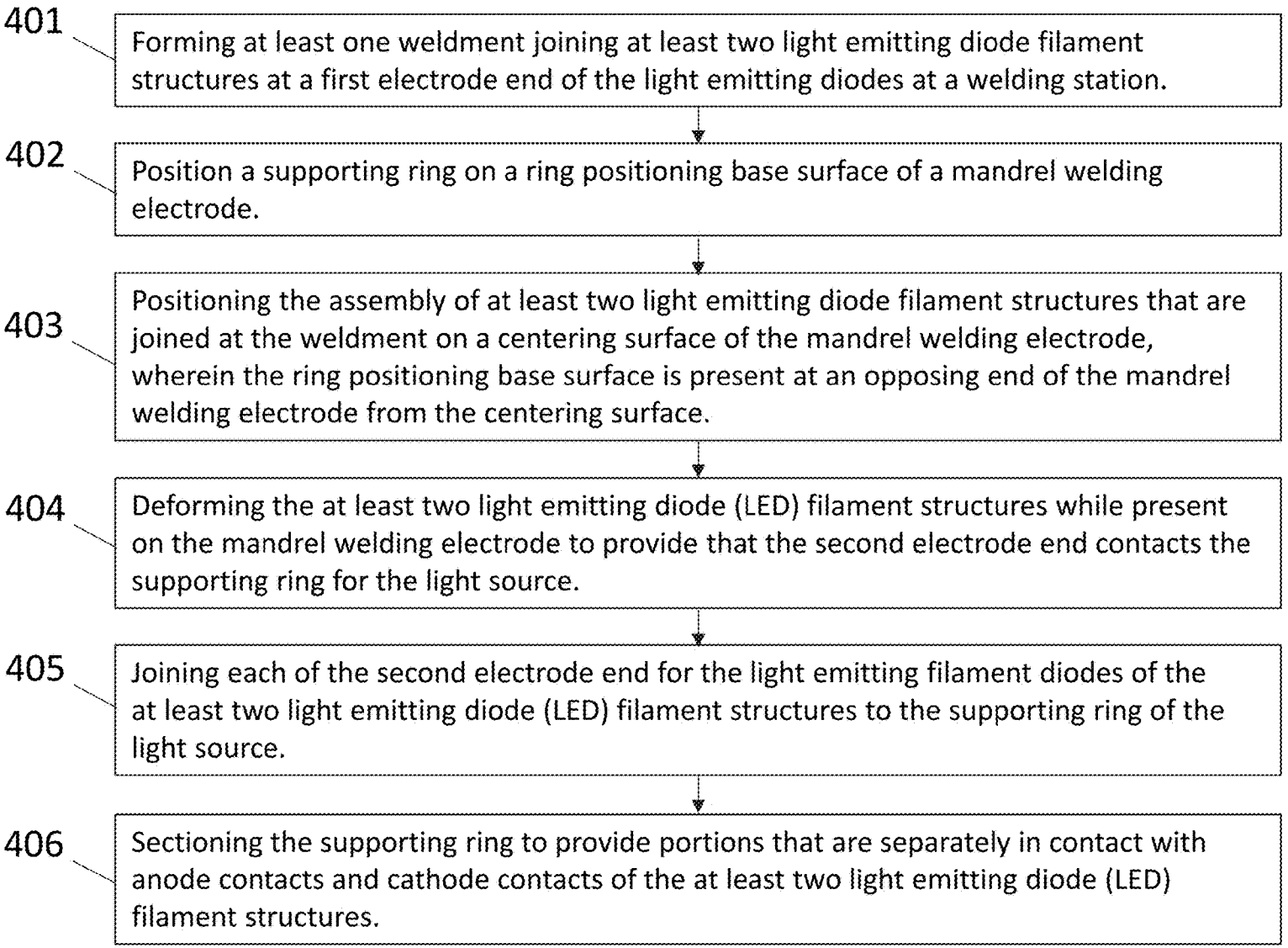
FIG. 12 is a flow chart describing one example of a process flow to provide the light engines described with reference to FIGS. 1A-5C, in which the process flow separates the welding stage that joins the first electrode ends of the light emitting diode (LED) filament structures that ultimately provide the common apex of the light source from the welding stage that engages the second electrode ends of the light emitting diode (LED) filament structures to the support ring 45.
Figure 13:
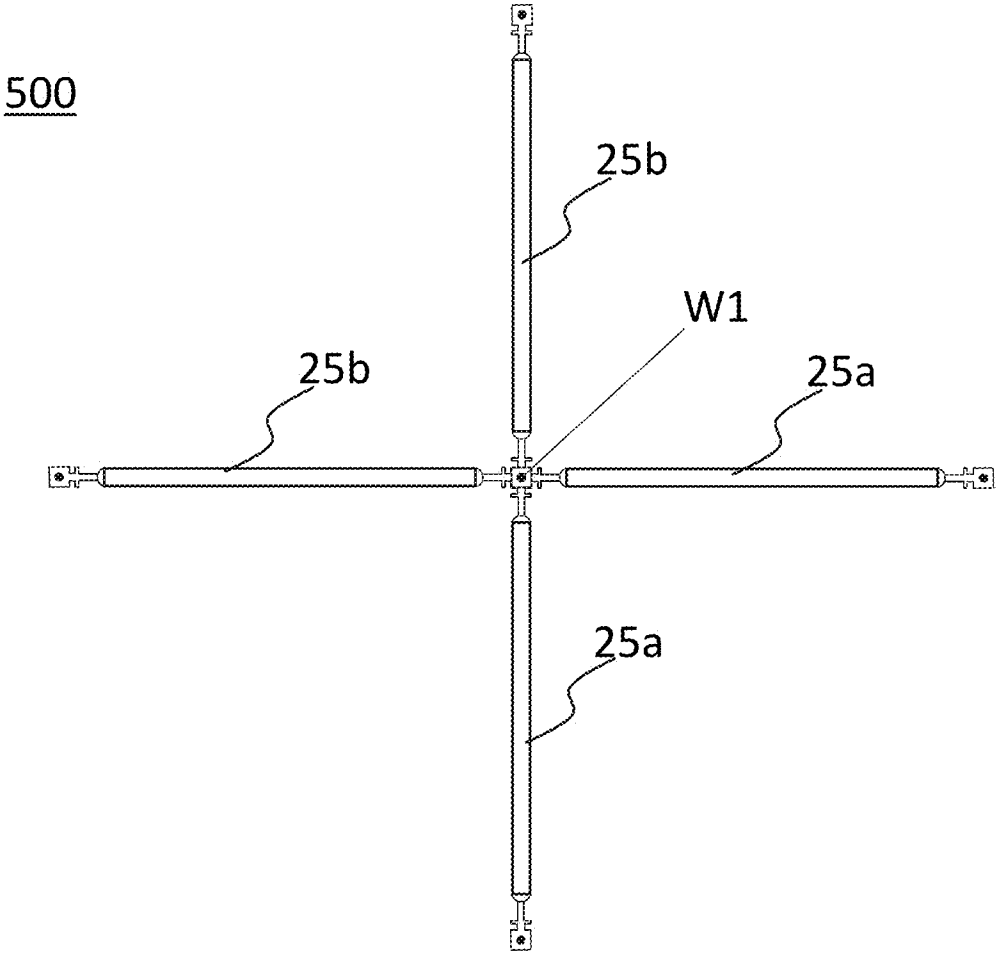
FIG. 13 is a top down view of a welded assembly produced by the welding stage described in FIG. 12 that joins the first electrode ends of the light emitting diode (LED) filament structures that ultimately provide the common apex of the light source.

Referring to FIG. 12, the method may begin with at least two light emitting diode filament structures 25*a*, 25*a*', 25*b*, 25*b*' being joined by weldment at a welding station that is separate from the mandrel welding electrode 85 at step 401. The welding station may include and electric resistance welding apparatus. FIG. 13 illustrates one example of a welded assembly 500 composed of least two light emitting diode filament structures 25*a*, 25*a*', 25*b*, 25*b*' being joined by weldment W1 at their first electrode end. The welded assembly 500 that is depicted in FIG. 13 is a flat structure, i.e., planar structure, in which the light emitting diode filament structures 25*a*, 25*a*', 25*b*, 25*b*' have not been deformed, i.e., they have not been bent. The filament structures 25*a*, 25*a*', 25*b*, 25*b*' that are joined by weldment have been described above with reference to FIGS. 1A-11C. For example, the weldment W1 is present in the frame assembly 60*a*, 60*b* portions that provide the anode and cathode contacts 26*a*, 27*a* for each of the plurality of light emitting diode (LED) filament structures 25*a*, 25*a*', 25*b*, 25*b*'. The weldment produced at this stage is ultimately positioned in the common apex A1 of the light source.

Referring to FIG. 12, in a following process step, the method may continue with positioning a supporting ring 45 on a ring positioning base surface 87 of a mandrel welding electrode 85 at step 402. Step 402 of the process flow depicted in FIG. 12 is similar to positioning the snap ring 45 (also referred to as the supporting ring) in the base surface of the mandrel welding electrode 85 that is depicted in FIG. 6. However, because the welding stage for joining the first electrode ends of the plurality of light emitting diode (LED) filament structures 25*a*, 25*a*', 25*b*, 25*b*' that provide the common apex A1 is separated from the process steps that are performed on the mandrel welding electrode 85, the base structure 90 and supporting pedestals 91 may be omitted.

Figure 14:
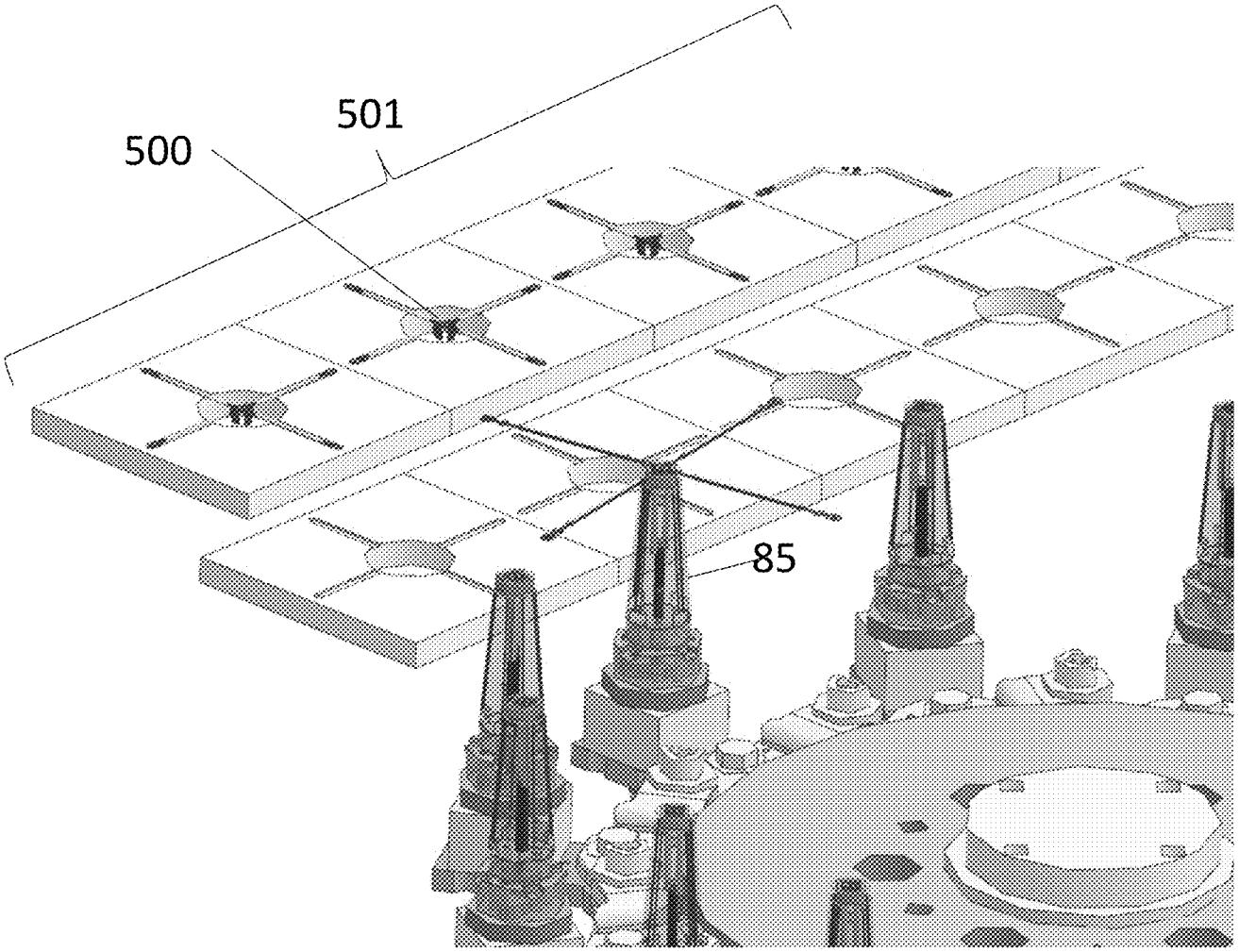
FIG. 14 is a perspective view illustrating positioning a welded assembly composed of least two light emitting diode filament structures being joined by weldment at their first electrode end on a centering surface of the mandrel welding electrode, in accordance with one embodiment of the present disclosure.

Referring to FIG. 12, in a following process step, the method may continue with positioning welded assembly 500 composed of least two light emitting diode filament structures 25*a*, 25*a*', 25*b*, 25*b*' being joined by weldment W1 at their first electrode end on a centering surface of the mandrel welding electrode 85 at step 403. FIG. 14 illustrates one mechanism by which this process step may be automated. A carrier 501 for the welded assembly 500 may load the welded assembly 500 onto one of a plurality of mandrel welding electrodes 85.

The method may continue with step 404 of the process flow depicted in FIG. 12, which includes deforming the at least two light emitting diode (LED) filament structures 25*a*, 25*a*', 25*b*, 25*b*' while present on the mandrel welding electrode 85 to provide that the second electrode end contacts the supporting ring 45 for the light source. This process step is similar to the deformation step that is described above with reference to FIGS. 10A and 10B. Therefore, the description of deforming the at least two light emitting diode (LED) filament structures 25*a*, 25*a*', 25*b*, 25*b*' to provide that their second electrode ends contact the supporting ring 45 (also referred to as snap ring 45) that is provided with reference to FIGS. 10A and 10B is suitable for describing the deformation process that is included in step 404 of the process flow depicted in FIG. 12. For example, at step 404, the light emitting diode (LED) filament structures 25*a*, 25*a*', 25*b*, 25*b*' can be deformed by the filament flange bending tool 95 to provide that the second electrode end, e.g., frame portions 60*a*, 60*b* of the anode and cathode contact portions 26*a*, 26*b*, 27*a*, 27*b*, contacts the supporting ring 45 for the light engine 100 at the second end of the mandrel welding electrode 85.

In a following process step, at step 405 of FIG. 12, the method may continue with joining each of the second electrode end for the light emitting filament diodes of the at least two light emitting diode (LED) filament structures 25*a*, 25*a*', 25*b*, 25*b*' to the supporting ring 45 of the light source. Step 405 of FIG. 12 is similar to the description of joining the second electrode end for the light emitting filament diodes of the at least two light emitting diode (LED) filament structures 25*a*, 25*a*', 25*b*, 25*b*' to the supporting ring 45 of the light source that is provided in the description of FIG. 10B. For example, the joining process may be by welding. In one embodiment, the type of welding employed to join the second electrode end for the filament light emitting diodes of the at least two light emitting diode (LED) filament structures 25*a*, 25*a*', 25*b*, 25*b*' to the snap ring 45 is electric resistance welding while the snap ring is present on the mandrel welding electrode 85.

Referring to step 406 of process flow depicted in FIG. 12, the supporting ring 45 may be sectioned to provide portions that are separately in contact with anode contacts 50*a* and cathode contacts 50*b* of the at least two light emitting diode (LED) filament structures 25*a*, 25*a*', 25*b*, 25*b*'. In some examples, following joining of the second end of the light emitting diode (LED) filament structures 25*a*, 25*a*', 25*b*, 25*b*' to the snap ring 45, the light engine structure composed of the light emitting diode (LED) filament structures 25*a*, 25*a*', 25*b*, 25*b*' may be removed from the mandrel welding electrode 85.

The step of sectioning the supporting ring in step 406 of FIG. 12 may be provided by the sequence depicted in FIGS. 11A-11C. FIGS. 11A-11C depict connecting the structure of the snap ring 45 and the connected light emitting diode (LED) filament structures 25*a*, 25*a*', 25*b*, 25*b*' to a stem 75, and sectioning the snap ring 45 to provide the anode supporting base contact 50*a* having the first arcular geometry and the cathode supporting base contact 50*b* having the second arcular geometry, for the light engine 100, 100*a*. The above description of FIGS. 11A-11C is suitable for describing at least one embodiment of a process flow that can provide step 406 of FIG. 12.

Figure 15:
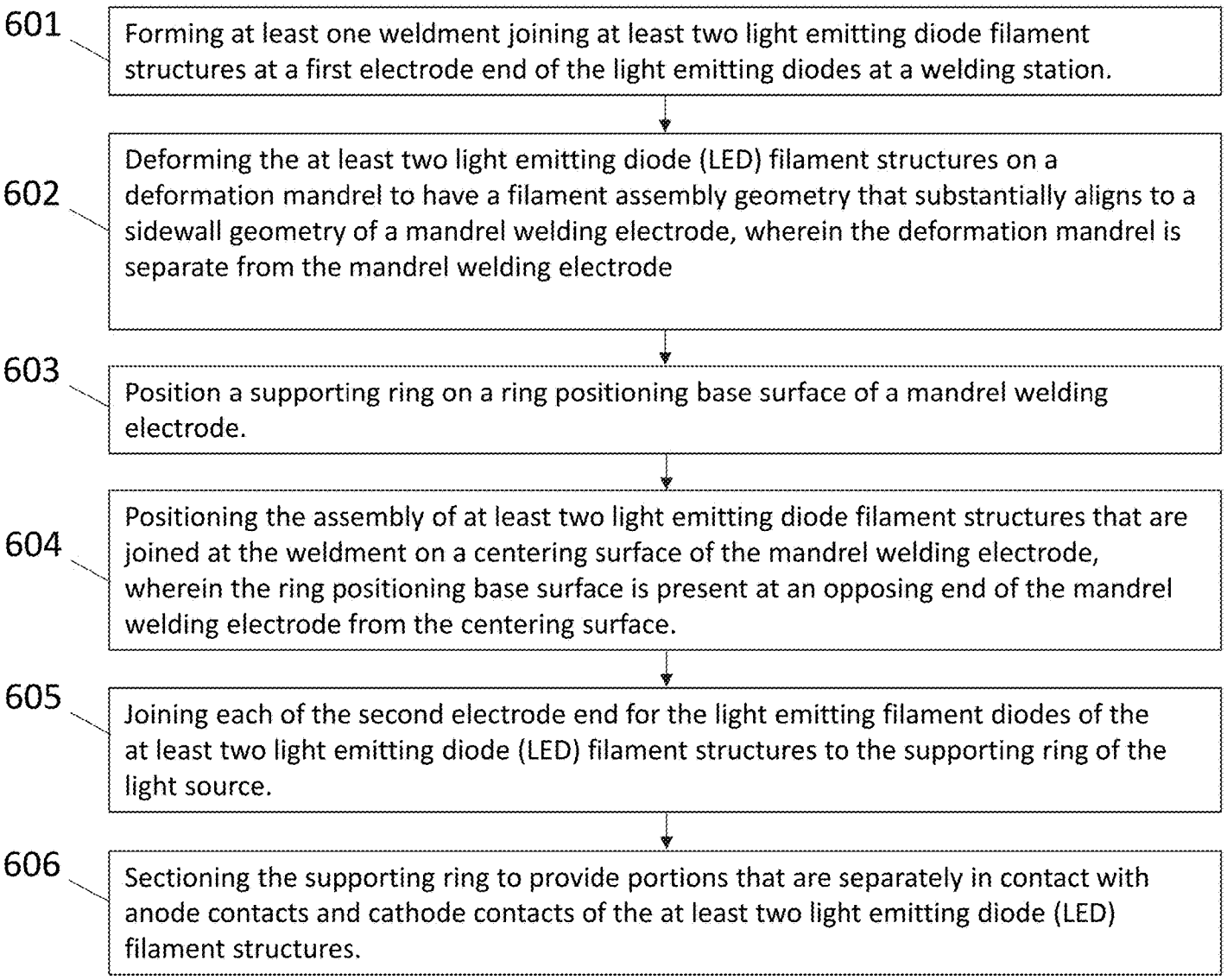
FIG. 15 is a flow chart describing one example of a process flow to provide the light engines described with reference to FIGS. 1A-5C, in which the process flow includes a deformation mandrel for shaping the geometry of the light source that is separate stage of the process flow from the mandrel welding electrode, in accordance with one embodiment of the present disclosure.

FIG. 15 is a flow chart describing another example of a process flow to provide the light engines described with reference to FIGS. 1A-5C, in which the process flow includes a deformation mandrel for shaping the geometry of the light source that is separate stage of the process flow from the mandrel welding electrode. The process flow described with reference to FIG. 15 may begin with step 601, which includes forming at least one weldment W1 joining at least two light emitting diode filament structures 25*a*, 25*a*', 25*b*, 25*b*' at a first electrode end of the light emitting diodes at a welding station. Step 601 of FIG. 15 has been described in step 401 of FIG. 12. One embodiment of the welded assembly 500 provided by step 601 is depicted in FIG. 13.

In a follow step 602, the method continues with deforming the at least two light emitting diode (LED) filament structures 25*a*, 25*a*', 25*b*, 25*b*' on a deformation mandrel to have a filament assembly geometry that substantially aligns to a sidewall geometry of a mandrel welding electrode. The deformation mandrel is separate from the mandrel welding electrode 85. Despite the deformation mandrel being a separate structure from the mandrel welding electrode 85, the geometry of the deformation mandrel is similar to the mandrel welding electrode 85 in order to provide that the at least two light emitting diode (LED) filament structures 25*a*, 25*a*', 25*b*, 25*b*' are bent to such a geometry on the deformation mandrel so that when they are removed from the deformation mandrel and fitted to the mandrel welding electrode 85, the second electrode ends of the at least two light emitting diode (LED) filament structures 25*a*, 25*a*', 25*b*, 25*b*' contact the support ring 45 that is fitted to the ring positioning base surface 87 of the mandrel welding electrode 85. With the exception of the ability of the mandrel welding electrode 85 to function as a welding apparatus, the description of the mandrel welding electrode including its function as a deformation surface is suitable for describing the geometry and deformation functions of the deformation mandrel. For example, the light emitting diode (LED) filament structures 25*a*, 25*a*', 25*b*, 25*b*' can be deformed by the filament flange bending tool 95 in combination with the deformation mandrel to provide that the second electrode end, e.g., frame portions 60*a*, 60*b* of the anode and cathode contact portions 26*a*, 26*b*, 27*a*, 27*b*, contacts the supporting ring 45 for the light engine 100 at the second end of the mandrel welding electrode 85.

At step 603, the method can continue with positioning a supporting ring on a ring positioning base surface 87 of the mandrel welding electrode 85. The description of step 402 of the method illustrated in the flow chart depicted in FIG. 12 is suitable for describing at least one embodiment of step 603 for the process flow that is illustrated in FIG. 15.

Step 604 of the method depicted in FIG. 15 includes positioning the assembly of at least two light emitting diode filament structures 25*a*, 25*a*', 25*b*, 25*b*' that are joined at the weldment W1 on a centering surface of the mandrel welding electrode 86. The welded assembly at this stage of the process flow has also been subjected to a deformation step, i.e., metal forming step, to provide that the filament assembly geometry substantially aligns to a sidewall geometry of the mandrel welding electrode 85. For example, when the welded and formed assembly is placed on the mandrel welding electrode 85, the common apex A1 of the light engine 100 is positioned on the centering surface of the mandrel welding electrode 85, and the second electrode ends of the least two light emitting diode filament structures 25*a*, 25*a*', 25*b*, 25*b*' contact the support ring 45 at the ring positioning base surface 87 of the mandrel welding electrode 85.

Step 605 of the method depicted in FIG. 15 includes joining each of the second electrode end for the light emitting filament diodes of the at least two light emitting diode (LED) filament structures 25*a*, 25*a*', 25*b*, 25*b*' to the supporting ring 45 of the light source. The description of step 405 of the method illustrated in the flow chart depicted in FIG. 12 is suitable for describing at least one embodiment of step 605 for the process flow that is illustrated in FIG. 15.

Step 606 of the method depicted in FIG. 15 includes sectioning the supporting ring 45 to provide portions that are separately in contact with anode contacts and cathode contacts of the at least two light emitting diode (LED) filament structures. The description of step 406 of the method illustrated in the flow chart depicted in FIG. 12 is suitable for describing at least one embodiment of step 606 for the process flow that is illustrated in FIG. 15.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Having described preferred embodiments of a self-supporting filament light emitting diode light engine lamp assembly, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method of forming a light source comprising:

positioning anode and cathode contacts for the light source on a base surface of a mandrel welding electrode;

positioning at least two light emitting diode filament structures that are joined at a weldment at a first electrode end for the filament light emitting diodes on a centering surface at first end of the mandrel welding electrode, wherein the base surface is present at an opposing second end of the mandrel welding electrode; and joining each of a second electrode end for the at least two light emitting diode (LED) filament structures to the anode and cathode contacts of the light source.

2. The method of claim 1, wherein each of the at least two light emitting diode filament structures comprise an anode contact at a first end, a cathode contact at an opposing second end, a substrate positioned between the anode contact and the cathode contact, and a plurality of series connected light emitting diodes present on the substrate and extending from the cathode contact to the anode contact.

3. The method of claim 1, wherein the at least two light emitting diode filament structures are joined by the weldment at a welding station that is separate from the mandrel welding electrode.

4. The method of claim 3, wherein following said welding station at which the at least two light emitting diode filament structures are joined by weldment, the at least two light emitting diode filament structures that are joined at the weldment are deformed on a deformation mandrel to have a filament assembly geometry that substantially aligns to a sidewall geometry of the mandrel welding electrode, wherein the deformation mandrel is separate from the mandrel welding electrode.

5. The method of claim 3, wherein the at least two light emitting diodes are joined by at a first end electrode end at said welding station, and following said welding station, the method further comprise deforming the at least two light emitting diode (LED) filament structures while present on the mandrel welding electrode to provide that the second electrode end contacts the anode and cathode contacts of the light source.

6. The method of claim 1, further comprising: positioning the mandrel welding electrode in a base structure having a plurality of perimeter supporting pedestals; and positioning the anode and cathode contacts for the light source on the base surface of the mandrel welding electrode after the mandrel welding electrode is present in the base structure.

7. The method of claim 6, wherein said positioning the at least two light emitting diode filament structures that are joined at the weldment on the centering surface at the first end of the mandrel welding electrode comprises: positioning said at least two light emitting diode (LED) filament structures on the mandrel welding electrode and the base structure, wherein for filament light emitting diodes of said at least two light emitting diode (LED) filament structures a first electrode end is positioned on the centering surface of the mandrel welding electrode and a second electrode end is positioned on one of said plurality of perimeter supporting pedestals; and joining together each of the first electrode end for the filament light emitting diodes of the at least two light emitting diode (LED) filament structures at the centering surface of the mandrel welding electrode to provide said weldment.

8. The method of claim 7, wherein following providing said weldment that joins the at least two light emitting diode filament structures, the method comprises: removing support to the second electrode end for the filament light emitting diodes of the at light emitting diode (LED) filament structures that was provided by the plurality of perimeter supporting pedestals; and deforming the at least two light emitting diode (LED) filament structures on the mandrel welding electrode to provide that the second electrode end contacts the anode and cathode contacts for the light source at the second end of the mandrel welding electrode, wherein the mandrel welding electrode includes a planar upper surface for the centering surface and a tapered sidewall extending from the planar upper surface to the ring positioning base surface, wherein a transition between the planar upper surface and the tapered sidewall provides a deformation surface with a bending angle that provides that during said deforming of the at least two light emitting diode (LED) filament structures the second electrode end contacts the anode and cathode contacts of the light source.

9. The method of claim 8, wherein during said deforming of the at least two light emitting diode (LED) filament structures a filament flange bending tool presses the at least two light emitting diode (LED) filament structures into contact with the deformation surface of the mandrel welding electrode.

10. The method of claim 1, wherein said at least two light emitting diode (LED) filament structures are sectioned from a frame assembly of filaments connected to provide that a length of adjacent filaments are parallel to one another, wherein the anode contacts and cathode contacts are provided by sectioned portions of a frame structure connecting the adjacent filaments in the frame assembly.

* * * * *